US007357731B2

(12) United States Patent
Johnson et al.

(10) Patent No.: US 7,357,731 B2
(45) Date of Patent: Apr. 15, 2008

(54) GOLF CLUB MADE OF A BULK-SOLIDIFYING AMORPHOUS METAL

(76) Inventors: William L. Johnson, 3546 Mountain View, Pasadena, CA (US) 91007; Choongnyun Paul Kim, 19747 Mariposa Creek Way, Northridge, CA (US) 91326; Atakan Peker, 17 Coffeeberry, Aliso Viejo, CA (US) 92656

( * ) Notice: Subject to any disclaimer, the term of this patent is extended or adjusted under 35 U.S.C. 154(b) by 0 days.

(21) Appl. No.: 11/288,492

(22) Filed: Nov. 28, 2005

(65) Prior Publication Data

US 2006/0154745 A1 Jul. 13, 2006

Related U.S. Application Data

(63) Continuation-in-part of application No. 10/685,950, filed on Oct. 14, 2003, now abandoned, which is a continuation of application No. 08/963,131, filed on Oct. 28, 1997, now Pat. No. 6,685,577, which is a continuation-in-part of application No. 08/677,488, filed on Jul. 9, 1996, now abandoned, which is a continuation-in-part of application No. 08/566,885, filed on Dec. 4, 1995, now abandoned, application No. 11/288,492, which is a continuation-in-part of application No. 10/735,148, filed on Dec. 12, 2003, which is a continuation of application No. 09/890,480, filed on Apr. 2, 2002, now Pat. No. 6,709,536.

(51) Int. Cl.
*A63B 53/04* (2006.01)

(52) U.S. Cl. ..... 473/349; 473/345

(58) Field of Classification Search ..... 473/324, 473/345, 346, 348–350; 148/403, 421, 561; 420/422, 423
See application file for complete search history.

(56) References Cited

U.S. PATENT DOCUMENTS

| | | | |
|---|---|---|---|
| 4,699,383 | A | 10/1987 | Kobayashi |
| 4,708,347 | A | 11/1987 | Kobayashi |
| 4,754,975 | A | 7/1988 | Aizawa |
| 5,024,437 | A | 6/1991 | Anderson |
| 5,032,196 | A | 7/1991 | Masumoto et al. |
| 5,074,935 | A | 12/1991 | Masumoto et al. |

(Continued)

FOREIGN PATENT DOCUMENTS

| | | |
|---|---|---|
| JP | 59-116059 | 7/1984 |

(Continued)

OTHER PUBLICATIONS

Anon, "Physics in the Material World," The Economist, Feb. 12, 1994, pp. 85-86.

(Continued)

*Primary Examiner*—Mark S Graham
(74) *Attorney, Agent, or Firm*—Kauth, Pomeroy, Peck & Bailey LLP

(57) ABSTRACT

A golf club is made of a club shaft and a club head. Either the club shaft or the club head is made at least in part of a in-situ composite of bulk-solidifying amorphous alloy. The weights of the various club heads of a set, which have different volumes, may be established by varying the compositions and thence the densities of the bulk-solidifying amorphous alloys.

21 Claims, 8 Drawing Sheets

U.S. PATENT DOCUMENTS

| | | | | |
|---|---|---|---|---|
| 5,094,383 | A | 3/1992 | Anderson et al. | |
| 5,188,152 | A | 2/1993 | Ogawa | |
| 5,208,090 | A | 5/1993 | Okitsu et al. | |
| 5,226,652 | A | 7/1993 | Sato | |
| 5,255,918 | A | 10/1993 | Anderson et al. | |
| 5,261,663 | A | 11/1993 | Anderson | |
| 5,261,664 | A | 11/1993 | Anderson | |
| 5,288,344 | A | 2/1994 | Peker et al. | |
| 5,344,140 | A | 9/1994 | Anderson | |
| 5,368,659 | A | 11/1994 | Peker et al. | |
| 5,417,419 | A | 5/1995 | Anderson et al. | |
| 6,162,130 | A * | 12/2000 | Masumoto et al. | 473/324 |
| 6,685,577 | B1 * | 2/2004 | Scruggs et al. | 473/349 |
| 6,709,536 | B1 * | 3/2004 | Kim et al. | 148/561 |
| 7,090,733 | B2 * | 8/2006 | Munir et al. | 148/561 |

FOREIGN PATENT DOCUMENTS

| | | |
|---|---|---|
| JP | 59-133266 | 7/1984 |
| JP | 1-176467 | 7/1989 |
| JP | 4-336083 | 11/1992 |
| JP | 7-62502 | 3/1995 |
| WO | WO 94/23078 | 10/1994 |

OTHER PUBLICATIONS

Translation of the Interview with John K. Thorne, Golf Equipment Magazine, Jun. 12, 1995.

Peker, A., et al., "A Highly Processable Metallic Glass: $Zr_{41.2}$ $Ti_{13.6}$ $Cu_{12.5}$ $Be_{22.5}$, " Appl.Phys.Lett., vol. 63, No. 17, Oct. 25, 1993.

Inoue, A., et al., "Production of Amorphous Cylinder and Sheet of $La_{55}$ $Al_{25}Ni_{20}$ alloy by a Metallic Mold Casting Method," Materials Transactions, JIM, vol. 31, No. 5 (May 1990).

Zhang, T., et al., "Amorphous Zr-Al-TM (TM=Co,Ni,Cu) Allys with Significant Supercooled Liquid Region of Over 100K," Materials Transaction, JIM, vol. 32, No. 11, Nov. 1991.

Inoue A., el al., "Mg-Cu-Y Bulk Amorphous Alloys with High Tensile Strength Produced by a High-Pressure Die Casting Method," Materials Transactions, JIM, vol. 33 No. 10 (Oct. 1992).

Bruck, K.A., et al. "Quasi-Static Constitutive Behavior of $Zr_{41.25}$ $Ti_{1.75}$ $Ni_{10}$ $Cu_{12.5}$ $Be_{12.5}$ Bulk Amorphous Alloys," Scripta Metallurgical et Materials, vol. 30, pp. 429-434.

* cited by examiner

GOLF CLUB MADE OF A BULK-SOLIDIFYING AMORPHOUS METAL

CROSS-REFERENCE TO RELATED CASES

This application is a continuation-in-part of U.S. application Ser. No. 10/685,950, filed Oct. 14, 2003, now abandoned which is a continuation of U.S. application Ser. No. 08/963,131, filed Oct. 28, 1997, now U.S. Pat. No. 6,685,577 which is in turn a continuation-in-part of abandoned U.S. application Ser. No. 08/677,488, filed Jul. 9, 1996, now abandoned which in turn is a continuation-in-part of abandoned U.S. application Ser. No. 08/566,885, filed Dec. 4, 1995, for which priority is claimed and the disclosures of which are incorporated herein by reference. This application is also a continuation-in-part of U.S. application Ser. No. 10/735,148, filed Dec. 12, 2003, which itself is a continuation of U.S. application Ser. No. 09/890,480, filed Apr. 2, 2002, now U.S. Pat. No. 6,709,536 which claims priority to PCT Applicaton No. PCT/US00/11790, which was filed May 1, 1999, which claims priority to U.S. Provisional Application Ser. No. 60/131,973, for which priority is claimed and the disclosures of which are incorporated herein by reference.

FIELD OF THE INVENTION

This invention relates to golf clubs, and, more particularly, to in-situ composite of bulk-solidifying amorphous alloys for use in the construction of the golf club shaft and the golf club head.

BACKGROUND OF INVENTION

In the sport of golf, the golfer strikes a golf ball with a golf club. The golf club includes an elongated club shaft, which is attached at one end to an enlarged club head and is wrapped at the other end with a gripping material to form a handle. The clubs are divided into several groups, depending upon the function of the club. These groups include the drivers, the irons (including wedges for the present purposes), and the putters.

Because golf has become a highly popular spectator and participant sport, a great deal of development effort has been devoted to golf clubs. Both the design of the clubs and the materials of construction have been improved in recent years. The present invention deals primarily with the materials of construction of golf clubs, and the following discussion will emphasize that subject area.

Until recent years, both the club shaft and the club head have been made primarily of metals such as steel and/or aluminum alloys. Composite-material shafts made of graphite-fiber-reinforced polymeric materials have been introduced, to reduce the weight and increase the material stiffness of the shaft. Heads made of specialty materials such as titanium alloys have been developed, to achieve reduced club head mass and density with high material stiffness so that the club head speed may be increased. The use of such materials also permits the manufacture of a larger-sized club head with the same mass or with redistributed weight and better performance. This brief discussion of new materials used in golf club shafts and heads is by no means exhaustive, and many other materials have been tried in order to achieve particular club behavior based upon various theories of club performance.

There remains a need, however, for further improvements in golf clubs in order to attain high durability and toughness of hitting face at low stiffness levels and high strength at low weight. These properties, in turn, lead to higher club head speed and a higher degree of energy transfer from the club to the ball upon impact, thereby permitting any player to perform to the best of his or her ability without being limited by the nature of the golf clubs. The present invention fulfills this need, and further provides related advantages.

SUMMARY OF THE INVENTION

The present invention provides a golf club with an improved material of construction. The golf club exploits the high elastic strain limit, low specific modulus and high specific strength of the material to provide a high degree of energy transfer from the club to the ball upon impact. The club is also corrosion resistant and wear resistant providing cosmetic and design durability. The club shaft and head are readily fabricated. For some clubs, the material of construction permits the configuration of the golf club to be modified so as to improve its performance.

In accordance with the invention, a golf club comprises a club shaft and a club head. Either or both of the club shaft and the club head are made at least in part of a in-situ composite of bulk-solidifying amorphous alloy. If the club shaft is made at least in part of composite material, the entire shaft is desirably made of the composite material. If the club head is made at least in part of the composite material, at least the club head face is made of the composite material. The club head face may be made thinner and lighter when it is made of the composite material than when it is made of conventional metals, allowing a desirable redistribution of the weight of the club head toward the periphery of the club head.

The in-situ composite of bulk-solidifying amorphous alloy comprises a ductile crystalline phase distributed in a fully amorphous matrix. The composite is formed in-situ by cooling the from a fully molten alloy, wherein the ductile crystalline phase precipitates first upon cooling and then the remaining molten alloy freezes into an amorphous matrix. The ductile crystalline phase is preferably a primary crystalline phase of the main constituent element of the alloy and in dendritic form.

A preferred composition for in-situ composite of bulk-solidifying amorphous alloy is, in atom percent, from about 45 to about 75 percent total of zirconium plus titanium, from about 5 to about 30 percent beryllium, from about 3 to 20 percent Niobium, and from about 5 to about 30 percent total of copper plus nickel, plus incidental impurities, the total of the percentages being 100 atomic percent. A preferred composition of the ductile crystalline phases in the in-situ composite is primarily Zr, Ti and Nb with substantially similar ratio in the overall alloy and with the total of other elements less than 10 atomic percent A preferred composition for the bulk-solidifying amorphous alloy matrix is, in atom percent, from about 45 to about 67 percent total of zirconium plus titanium, from about 10 to about 35 percent beryllium, and from about 10 to about 38 percent total of copper plus nickel, plus incidental impurities, the total of the percentages being 100 atomic percent. Other in-situ composites of bulk-solidifying amorphous alloys and matrix of amorphous alloys may also be used There is provided in practice of this invention, a method for forming a composite metal object comprising ductile crystalline metal particles in an amorphous metal matrix. An alloy is heated above the melting point of the alloy, i.e. above its liquidus temperature. Upon cooling from the high temperature melt, the alloy chemically partitions; i.e., undergoes partial crystallization by nucleation and subsequent growth of a crystalline phase in the remaining liquid. The remaining liquid, after cooling below the glass transition temperature (considered as a solidus) freezes to the amorphous or glassy state, producing a two-phase microstructure containing crystalline particles (or dendrites) in an amorphous metal matrix; i.e., a bulk metallic glass matrix.

This technique may be used to form a composite amorphous metal golf club having all of its dimensions greater than one millimeter. Such a club would comprise an amorphous metal alloy forming a substantially continuous matrix, and a second ductile metal phase embedded in the matrix. For example, the second phase may comprise crystalline metal dendrites having a primary length in the range of from 30 to 150 micrometers and secondary arms having a spacing between adjacent arms in the range of from 1 to 10 micrometers, more commonly in the order of about 6 to 8 micrometers.

In a preferred embodiment the second phase is formed in situ from a molten alloy having an original composition in the range of from 52 to 75 atomic percent zirconium, 3 to 17 atomic percent titanium, 2.5 to 8.5 atomic percent copper, 2 to 7 atomic percent nickel, 5 to 15 atomic percent beryllium, and 3 to 20 atomic percent niobium. Other metals that may be present in lieu of or in addition to niobium are selected from the group consisting of tantalum, tungsten, molybdenum, chromium and vanadium. These elements act to stabilize bcc symmetry crystal structure in Ti- and Zr-based alloys.

Manufacture of a portion of the golf club from a composite amorphous metal yields surprising and unexpected improvements in club performance. If the club shaft is made of the composite amorphous metal, it is flexible and strong sustaining large elastic deformations and as such storing larger amount of potential energy to be converted into kinetic energy. If the club head is made of the composite amorphous metal, it is flexible, strong, and tough, thereby resisting damage resulting from impact of the club head with the golf ball. In both components, the composite. amorphous metal sustains very high levels of elastic deformation with essentially no plastic deformation. It has been demonstrated that elastic tensile strains of up to about 2 percent are achieved with essentially no inelastic or plastic response of the material. Accordingly, the large elastic strains sustained during impact of the club head with the ball are accompanied by essentially no inelastic or plastic response. Consequently, virtually no energy is absorbed during the deformation of the club head during impact with the golf ball. A higher fraction of the energy of the golfer's swing is therefore transferred into the golf ball upon impact than in the case of the use of a material which exhibits a significant degree of absorption of energy by an elastic or plastic deformation.

In one embodiment of the invention, the golf club face is made of a in-situ composite material with an elastic strain limit of more than 1.5%, a Young Modulus of less than 75 GPa, a yield strength of more than 1.4 GPa and a tensile ductility of more than 5%.

The approach of the present invention also permits the weights of the different club heads in a club set to be varied independently of the volume of the club head or in conjunction with the volume of the club head in an arbitrary manner. The shapes and volumes of different club heads in a set vary. By custom and tradition, club weights increase from a 2-iron to a sand wedge. In the conventional approach, optimal design deals with the shape (i.e., volume) of the club head. The weights of the individual clubs cannot be varied outside of limits established either by professional standards or established user preferences. When conventional materials are used to make the club heads, the weights of the club heads vary directly proportionally to the volume of the club head.

According to the present invention, a set of golf clubs comprises a first club having a first club head with a first volume and made of a first composite amorphous metal having a first composition and a first density. The set further comprises a second club having a second club head with a second volume and made of a second composite amorphous metal having a second composition different from the first composition and a second density different from the first density. The first and second composite amorphous metals are preferably selected from the same alloy family, i.e., alloys whose compositions are within the same continuous range.

The compositions and densities within a composite amorphous metal system may be varied in small increments but over a wide range, permitting the weights of the club heads to be arbitrarily determined by composition selection within a wide range. An example is useful in illustrating this point. If it were desired that the club heads of two different clubs should have the same weight, a first product of the first volume times the first density, the weight of the first club head, is made about the same as a second product of the second volume times the second density, the weight of the second club head. That is, for this constant-weight situation the compositions of the alloys used to make the club heads are selected so as to vary their densities inversely with the volume of the club heads for which they are to be used. Known composite amorphous metal families permit such density variation within the range of feasible club head design variations. The same principles are applied for the other clubs in the set. The golfer thus has a club set where the heads are of substantially constant weight, while also enjoying the other advantages of the composite amorphous metal.

The constant-weight example is just one case of the ability provided by the present invention to arbitrarily vary the club-head weights independently of the club-head volume. The weights of the club heads of the set may instead be made to vary in some other fashion, independently of the club volume. This capability permits the club designer wide latitude in selecting club-head shapes and weights. The wide range of weights and tailoring of the weights are achieved with a single composite amorphous metal, and without the use of cumbersome weights, plugs, or other inserts that alter the impact and mass-distribution properties of the club head.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIGS. 3A-3C are three enlarged sectional views of three embodiments of the club head, taken along lines 3-3 of FIG. 1, wherein FIG. 3A depicts a putter club head, FIG. 3B depicts an iron club head, and FIG. 3C depicts a driver club head;

DETAILED DESCRIPTION OF THE INVENTION

Figure 1:
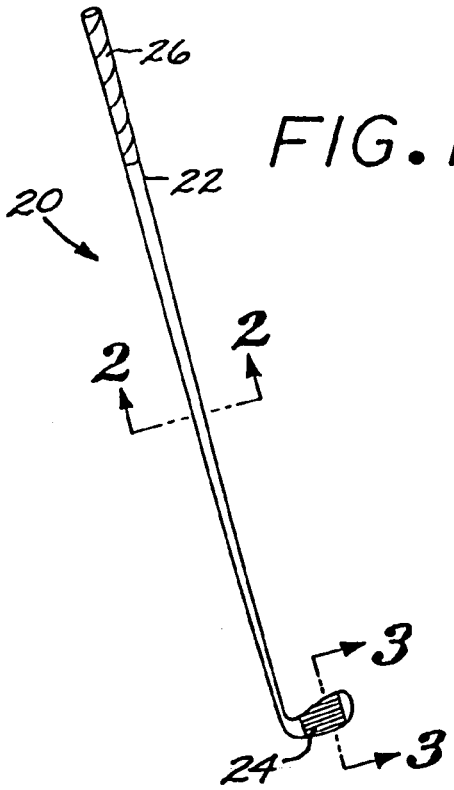
FIG. 1 is a perspective view of a golf club.
Figure 2:
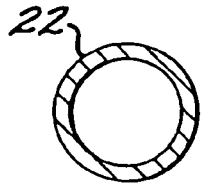
FIG. 2 is an enlarged sectional view of the club shaft, taken along lines 2-2 of FIG. 1.

FIG. 1 depicts a golf club 20. The golf club 20 includes a club shaft 22 and a club head 24 attached to a lower end of the club shaft 22. A handle 26 is formed at an upper end of the club shaft 22 by wrapping a gripping material around the club shaft 22. FIGS. 1-3, showing embodiments of the club, club shaft, and club head, are somewhat schematic in form and are intended to generally portray these elements. There are many variations of the basic design configuration of the golf club, and the present invention dealing with materials of construction is applicable to all of these variations.

The club shaft 22 is elongated and generally rod-like in form. The club shaft may be solid in cross section, or it may be hollow as shown in FIG. 2. The club shaft is preferably hollow in cross section in the present invention.

Figure 3A:
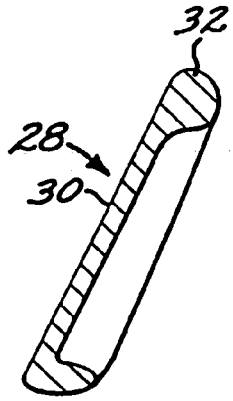
Figure 3B:
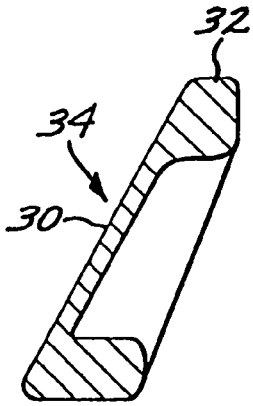
Figure 3C:
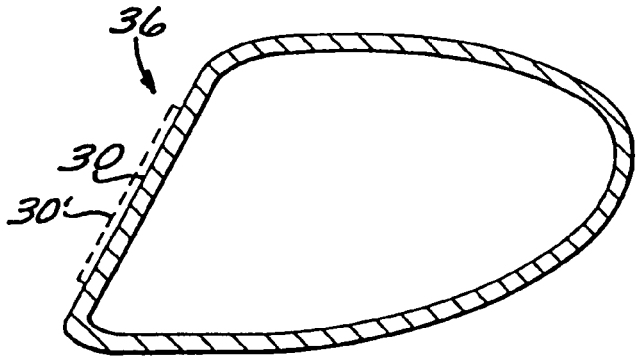

The club head 24 has many design variations, but they may be generally classified into three groups as shown in FIGS. 3. A putter club head 28 (FIG. 3A) has a club head face 30 with bolsters 32 at the ends. The club head face 30 is usually roughly vertical to the ground when the golf club is held by the user. An iron club head 34 (as used herein, irons include wedges), shown in FIG. 3B, has a similar construction, with a number of different angles of the club head face 30 to the ground available to aid the golfer to determine the loft of the shot. (The word "iron" is here a term of art for the type of club, and does not suggest that the club head is made of the metal iron.) A driver club head 36 may have the basic form of the putter head, but more preferably has a more massive, rounded body shape such as shown in FIG. 3C. As with the iron club head, the angle of the club head face 30 to the ground of the driver club head varies with different types of drivers. The club head face 30 maybe integral with the body of the club head. The club head face 30 may include a separate plate 30' that is fabricated separately and joined to the body of the club head, as shown in dashed lines in FIG. 3C.

Either the club shaft 22 or the club head 24 is made at least in part of a in-situ composite of bulk-solidifying amorphous alloy, preferably by casting the alloy to shape in a properly configured mold. Bulk-solidifying amorphous alloys are a recently developed class of amorphous alloys that retain their amorphous structures when cooled from high temperatures at critical cooling rates of about 500° C. or less, depending upon the alloy composition. Bulk-solidifying amorphous alloys have been described, for example, in U.S. Pat. Nos. 5,288,344, 5,368,659, and 5,032,196, whose disclosures are incorporated by reference.

Figure 7:
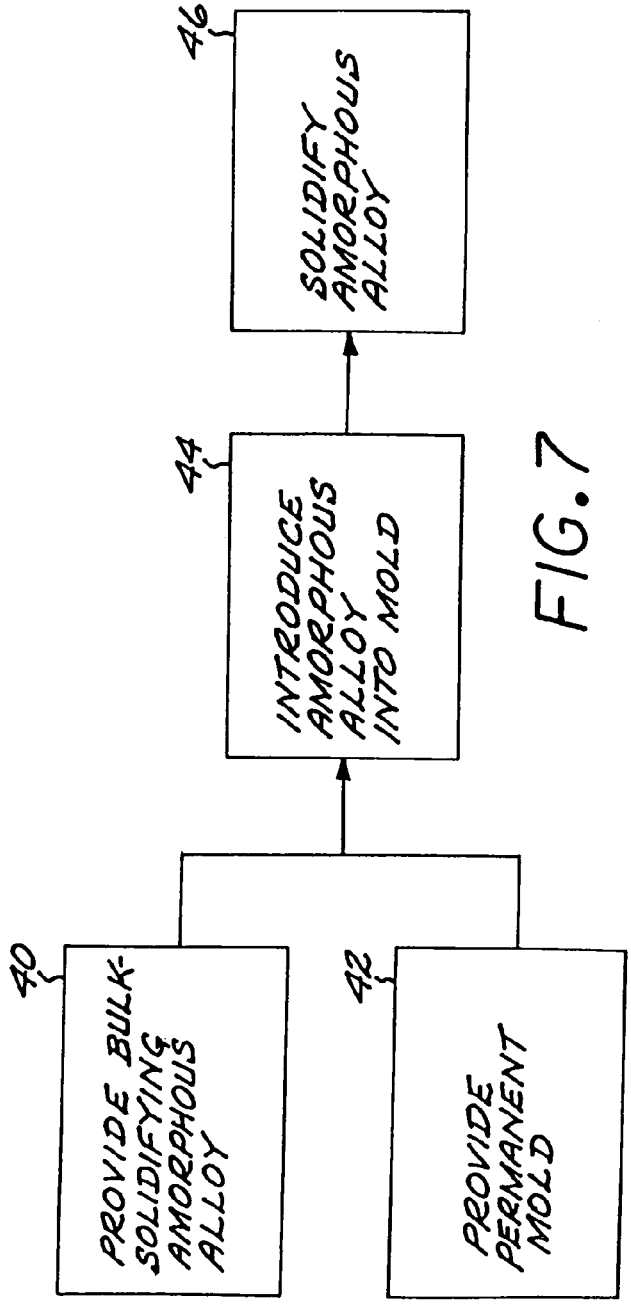
FIG. 7 is a block flow diagram of an approach for preparing a cast golf club component.

The golf club component made of the composite of bulk-solidifying amorphous alloy is preferably made by "permanent mold casting", which, as used herein, includes die casting or any other casting technique having a permanent mold into which metal is introduced, as by pouring, injecting, vacuum drawing, or the like. Referring to FIG. 7, a composite of bulk-solidifying amorphous alloy in fully molten form, to be described in greater detail subsequently, is provided, numeral 40. A permanent mold having a mold cavity defining the shape of the golf club component, such as the golf club head, is provided, numeral 42. The composite of amorphous alloy is heated to a temperature above liquidus temperature such that it may be introduced into the permanent mold, numeral 44. The molten alloy is cooled to relatively low temperature, such as room temperature, at a rate sufficiently high that the amorphous structure with ductile crystalline precipitates is retained in the final cast product, numeral 46.

This approach is to be contrasted with the processing used with conventional materials. Golf club heads made of conventional high strength materials such as titanium and steel are investment cast by the lost wax process or forged to shape. Both techniques require finishing operations such as machining and grinding. The investment casting process provides moderately low-cost products that are not technologically the equal of forged products, whereas forging provides higher quality products at a substantially higher cost. The quality of forged products is due to the higher strength of forged metals, more uniform and porosity-free structure, and better control of dimensions such as wall thicknesses than possible with investment casting. Investment cast products such as golf-club heads have lower strengths due to porosity, and they exhibit shrinkage in the casting operations. A different mold is created from a wax pattern for each golf-club head that is to be investment cast. Consequently, the dimensions of the golf club head, such as its wall thickness, cannot be consistently reproduced due to movement of the wax pattern and other factors. The resulting article may therefore vary significantly from the design. The variations are such that some golf-club heads produced within the relatively wide tolerances of the investment casting process may not be within the relatively narrow tolerances of the club design, and accordingly must be scrapped. The tolerances of forging operations are narrower, but forging is considerably more costly than investment casting and typically requires some machining of the product.

The golf-club components made by permanent-mold casting of bulk-solidifying amorphous alloys and in-situ composites of bulk solidifying amorphous alloys overcome the shortcomings of the prior approaches by achieving good tolerances with much lower cost than possible with either investment cast or forged golf club heads. The golf-club component closely matches the design. The bulk-solidifying components made by permanent-mold casting have low or negligible shrinkage and porosity, leading to good strength and also to low variation in shape. They also exhibit excellent surface finish and replication of the mold interior. There are no spurious features due to the wax patterns sometimes found in investment cast articles or due to the forging defects sometimes found in forged articles. Only a single permanent mold is used, or a group of permanent molds are used which are carefully matched to each other because they are repeatedly used. In each case, the permanent mold or molds are carefully matched to the club design. The permanent mold casting of crystalline alloys such as titanium alloys and steels, used in conventional golf club heads, is not economically practical because of the higher mold wear experienced with these alloys, which have higher casting temperatures than known bulk-solidifying amorphous alloys. The solidification shrinkage and consequent warping of these conventional crystalline alloys also does not permit the net-shape casting possible with the bulk-solidifying amorphous alloys and in-situ composites of bulk solidifying amorphous alloys.

Bulk-solidifying amorphous metal alloys may be cooled from the melt at relatively low cooling rates, on the order of 500° C. per second or less, yet retain an amorphous structure. Such metals do not experience a liquid/solid crystallization transformation upon cooling, as with conventional metals. Instead, the highly fluid, non-crystalline form of the metal found at high temperatures becomes more viscous as the temperature is reduced, eventually taking on the outward physical appearance and characteristics of a conventional solid. Even though there is no liquid/solid crystallization transformation for such a metal, an effective "freezing temperature", $T_g$ (often referred to as the glass transition temperature), may be defined as the temperature below which the viscosity of the cooled liquid rises above $10^{13}$ poise. At temperatures below $T_g$, the material is for all practical purposes a solid. An effective "fluid temperature", $T_f$, may be defined as the temperature above which the viscosity falls below $10^2$ poise. At temperatures above $T_g$, the material is for all practical purposes a liquid. At temperatures between $T_f$ and $T_g$, the viscosity of the bulk-solidifying amorphous metal changes slowly and smoothly with temperature. For the zirconium-titanium-nickel-copper-beryllium alloy of the preferred embodiment, $T_g$ is about 350-400° C. and $T_f$ is about 700-800° C.

This ability to retain an amorphous structure even with a relatively slow cooling rate is to be contrasted with the behavior of other types of amorphous metals that require cooling rates of at least about $10^4$-$10^{6}$° C. per second from the melt to retain the amorphous structure upon cooling. Such metals may only be fabricated in amorphous form as thin ribbons or particles. Such a metal has limited usefulness because it cannot be prepared in the thicker sections required for typical articles of the type prepared by more conventional casting techniques, and it certainly cannot be used to prepare three-dimensional articles such as golf club shafts and heads.

A preferred type of bulk-solidifying amorphous alloy has a composition of about that of a deep eutectic composition. Such a deep eutectic composition has a relatively low melting point and a steep liquidus. The composition of the bulk-solidifying amorphous alloy should therefore preferably be selected such that the liquidus temperature of the amorphous alloy is no more than about 50-75° C. higher than the eutectic temperature, so as not to lose the advantages of the low eutectic melting point.

A most preferred type of bulk-solidifying amorphous alloy family has a composition near a eutectic composition, such as a deep eutectic composition with a eutectic temperature on the order of 660° C. This material has a composition, in atomic percent, of from about 45 to about 67 percent total of zirconium plus titanium, from about 10 to about 35 percent beryllium, and from about 10 to about 38 percent total of copper plus nickel, plus incidental impurities, the total of the percentages being 100 atomic percent. A substantial amount of hafnium may be substituted for some of the zirconium and titanium, aluminum may be substituted for the beryllium in an amount up to about half of the beryllium present, and up to a few percent of iron, chromium, molybdenum, or cobalt may be substituted for some of the copper and nickel. This bulk-solidifying alloy is known and is described in U.S. Pat. No. 5,288,344. A most preferred such metal alloy material, termed Vitreloy™-1, has a composition, in atomic percent, of about 41.2 percent zirconium, 13.8 percent titanium, 10 percent nickel, 12.5 percent copper, and 22.5 percent beryllium.

Another such metal alloy family material has a composition, in atom percent, of from about 25 to about 85 percent total of zirconium and hafnium, from about 5 to about 35 percent aluminum, and from about 5 to about 70 percent total of nickel, copper, iron, cobalt, and manganese, plus incidental impurities, the total of the percentages being 100 atomic percent. A most preferred metal alloy of this group has a composition, in atomic percent, of about 60 percent zirconium about 15 percent aluminum, and about 25 percent nickel. This alloy system is less preferred than that described in the preceding paragraph, because of its aluminum content. Other bulk-solidifying alloy families, such as those having even high contents of aluminum and magnesium, are operable but even less preferred.

Figure 4:
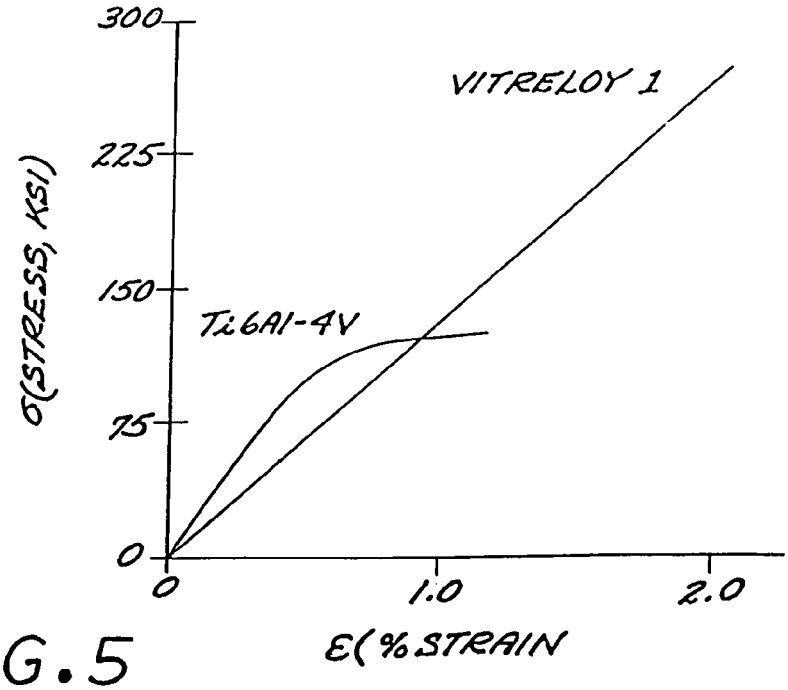
FIG. 4 are measured stress-strain curves for a titanium alloy and for a bulk-solidifying amorphous alloy.

The use of bulk-solidifying amorphous alloys in golf club shafts and/or club heads offers some surprising and unexpected advantages over conventional metals, metallic composites, and nonmetallic composites used as materials of construction. The bulk-solidifying amorphous alloys exhibit a large fully-elastic deformation without any yielding, as shown in FIG. 4 for the case of Vitreloy™-1. This bulk-solidifying amorphous alloy strains 2 percent and to a stress of about 270 ksi (thousands of pounds per square inch) without yielding, which is quite remarkable for a bulk metallic material. The energy stored when the material is stressed to the yield point, sometimes termed $U_d$, is 2.7 ksi. By comparison, a current titanium alloy popular in some advanced golf club shafts and heads yields at a strain of about 0.65 percent and a stress of about 110 ksi, with a stored energy $U_d$ to the yield point of about 0.35 ksi. The best prior material for energy storage, a copper-beryllium alloy, has a $U_d$ of about 1.15 ksi, less than half that of the preferred bulk-solidifying amorphous alloy.

Another important material property affecting the performance of the club head is the energy dissipation in the club head as the ball is hit. Many metallic alloys experience micro-yielding in grains oriented for plastic micro-slip, even at applied stresses and strains below the yield point. For many applications the micro-yielding is not an important consideration. However, when the material is used in a club head face where there is a large impact force at the moment the club head hits the golf ball, the micro-yielding absorbs and dissipates energy that otherwise would be transferred to the ball.

Figure 5:
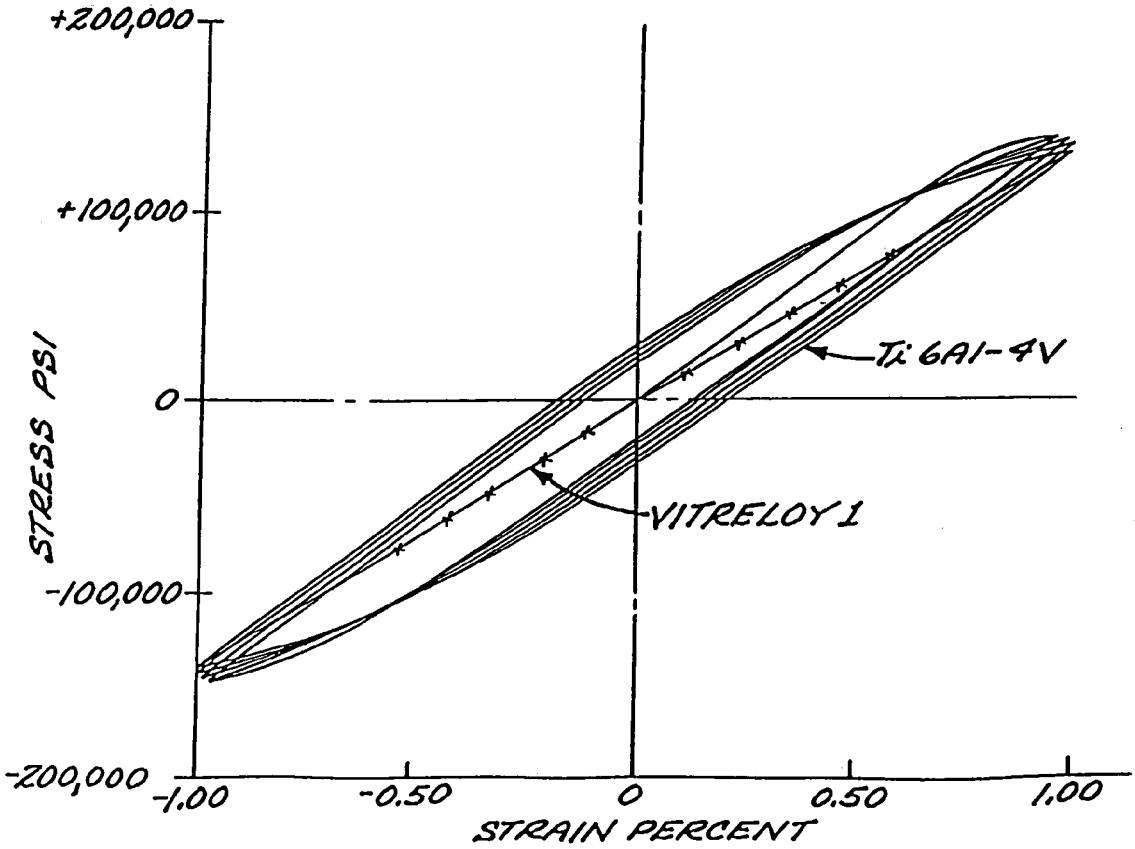
FIG. 5 is a measured graph of stress versus strain for a titanium alloy and for bulk-solidifying amorphous alloy (Vitreloy™-1) during cyclic straining of the materials.

FIG. 5 illustrates the deformation behavior of aircraft quality, forged and heat-treated titanium-6 weight percent aluminum-4 weight percent vanadium (Ti-6Al-4V), a known material for use in golf-club heads, as compared with that of the Vitreloy™-1 alloy, when strained to a level approximately indicative of local strains experienced by the club head face of a driver during impact with the golf ball. Yielding is evidenced by a hysteresis in the cyclic stress-strain curve upon repeated loading and reverse loading, even when the loading is below the macroscopic yield point (a phenomenon termed "micro-yielding"). The Ti-6Al-4V exhibits extensive hysteresis resulting from the yielding and micro-yielding. The Vitreloy™-1 bulk-solidifying amorphous alloy exhibits no hysteresis upon repeated loading and reverse loading. The absence of hysteresis in the loading behavior of the Vitreloy™-1 alloy results from the amorphous microstructure of the material wherein there are no grains or other internal structures which exhibit microplastic deformation and consequently micro-yielding during loading and reverse loading. This difference in behavior of conventional polycrystalline club head alloys and the amorphous alloys is further verified by improved performance in bounce tests wherein a metal ball is dropped onto the surface of the material. The bounce is significantly higher for the amorphous alloys than for the polycrystalline alloys, indicating less (and in fact, substantially no) energy absorption for the amorphous alloys and significant energy absorption for the polycrystalline alloys.

The desirable deformation behavior of the material of the club made according to the invention may be characterized as an elastic strain limit of at least about 1.5 percent, preferably greater than about 1.8 percent, and most preferably about 2.0 percent, with an accompanying plastic strain of less than about 0.01 percent, preferably less than about 0.001 percent up to the elastic strain limit. That is, the material exhibits substantially no plastic deformation when loaded to about 80 percent of its fracture strength.

The bulk-solidifying amorphous alloys have excellent corrosion resistance. They have as-cast surfaces that are very smooth, when cast against a smooth surface, making it attractive in appearance. The amorphous alloys may be readily cast as club shafts or heads using a number of techniques, most preferably permanent mold casting, permitting fabrication of the components at reasonable cost.

The preferred alloys used in the golf club have an exceedingly high strength-to-density ratio, on the order of twice that of metals currently used in golf club heads such as steel and Ti-6Al-4V alloy. This property of the materials may be characterized as a strength-to-density ratio of at least about $1\times10^6$ inches, and preferably greater than about $1.2\times10^6$ inches. This feature, together with the high elastic limit (FIG. 4) of the amorphous material and its low damping properties (FIG. 5), permits a surprising and unexpected redesign of the golf club head to achieve improved performance.

For example, the club head face (30 and/or 30') of the club head, which is near the point of impact of the ball, may be reduced in thickness, so that its mass may be redistributed to the periphery of the club head face and the club head. This redesign in turn gives the golf club head a greater moment of inertia about the point of impact, which leads to a greater stability against unwanted twisting motions of the club head. The redesign is accomplished without changing the overall mass of the club head. A club head face made with conventional steel or titanium materials is typically about 3 millimeters or more thick, so that it does not plastically buckle upon ball impact. A club head face made of the amorphous material of the invention may be made less than 2.5 millimeters thick, and most preferably in the range of from about 1.5 to about 2 millimeters thick. If it is less thick, there is a risk of plastic buckling upon impact. If it is thicker, the advantages discussed herein are lost. The thin club head face results in a "soft" feel to the club when a ball is impacted. The mass saved as a result of the reduction in thickness of the club head face may be redistributed to the periphery of the club head face or elsewhere at the periphery of the club, thereby providing the increased moment of inertia and greater stability discussed previously.

Figure 6B:
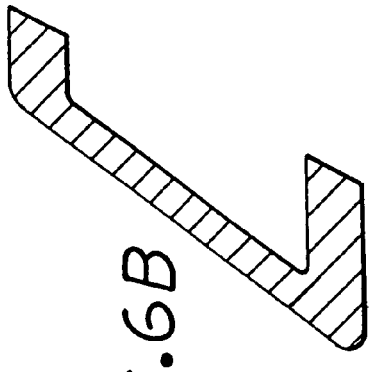
FIG. 6B is a side sectional view of a second iron club head having a second volume.
Figure 6A:
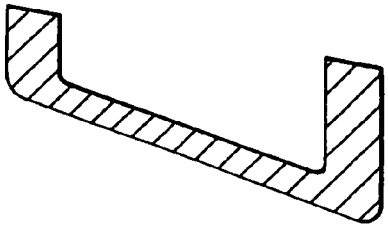
FIG. 6A is a side sectional view of a first iron club head having a first volume.

FIGS. 6A and 6B depict a particularly desirable application of the invention to a set of golf clubs. Within a set of clubs having drivers, irons, and a putter, the volumes of the club heads may vary considerably. For example, a typical 3-iron illustrated in FIG. 6A has a volume of about 31.2 cubic centimeters (cc), and a typical 8-iron illustrated in FIG. 6B has a volume of about 35.6 cc. The shapes of the club heads and thence their volumes are determined primarily by specifications established by the professional golfing associations. There is a trend, however, to the use of larger irons. When the two club heads are made of the same material, such as a conventional metal alloy, the weight of each club head varies proportionally to its volume.

The density properties of bulk-solidifying amorphous alloys offer two important advantages to the design of golf-club heads, not available with other candidate materials. The first is the absolute value of the density range of the materials, and the second is the ability to vary the density over a wide range while maintaining other pertinent mechanical and physical properties within acceptable ranges. As to the absolute value of the density range, the densities of the preferred bulk-solidifying amorphous alloys are from about 5.0 grams per cc to about 7.0 grams per cc. These densities may be compared with the densities of conventional candidate golf-club head materials such as copper-beryllium, density 8.0 grams per cc; steel, density 7.8 grams per cc; titanium, density 4.5 grams per cc; and aluminum, density 2.7 grams per cc. The densities of these conventional materials are relatively constant and cannot be readily varied. There is a large gap in density between copper-beryllium and steel, at the upper end, and titanium. The present alloys lie in this gap region of density. Their use permits, for example, an iron to have a larger size and volume than a steel iron, but to have about the same weight.

The second significant virtue of the use of amorphous alloys to manufacture the club heads is that their densities may be selectively varied over a moderately wide range of values. For example, within the broad composition range of the preferred alloy (having a composition, in atom percent, of from about 45 to about 67 percent total of zirconium plus titanium, from about 10 to about 35 percent beryllium, and from about 10 to about 38 percent total of copper plus nickel, plus incidental impurities, the total of the percentages being 100 atomic percent), the densities may be varied from about 5.0 grams per cc to about 7 grams per cc by changing the compositions while staying in the permitted range that results in a bulk-solidifying amorphous alloy.

A range of particular interest to the inventors is from about 5.7 grams per cc to about 6.2 grams per cc. Compositions of the bulk-solidifying amorphous alloys within the preferred range that yield densities within the range of particular interest are shown in the following table:

| | Composition (atomic %) | | | | |
|---|---|---|---|---|---|
| Density | Zr | Cu | Ti | Ni | Be |
| 6.2 | 44.4 | 13.5 | 10.9 | 10.4 | 20.8 |
| 6.0 | 37.3 | 9.7 | 18.9 | 9.3 | 24.8 |
| 5.9 | 35.6 | 8.9 | 20.3 | 9.3 | 25.9 |
| 5.7 | 29.6 | 8.3 | 27.7 | 8.1 | 26.3 |

This ability to vary the density of the metal is used to advantage by selecting the composition of the bulk-solidifying amorphous alloy so that its density times the volume of the club head, the total weight of the club head, meets a design value established by the club designer. The present inventors are not golf-club head designers, and the following examples are prepared for illustration purposes only. If a first club head (e.g., a 2-iron) has a design volume of about 39.3 cc and a second club head (e.g., an 8-iron) has a design volume of about 42.7 cc, to maintain the two club heads of approximately constant weight of 244 grams, the first club head maybe made of the bulk-solidifying amorphous alloy having a density of 6.2 grams per cc and the second club head may be made of the bulk-solidifying amorphous alloy having a density of about 5.7 grams per cc. The preceding table gives compositions suitable for achieving these densities. Because the compositions of both alloys are selected within the permissible range of the bulk-forming amorphous alloys, the club heads will both be amorphous and will be of about the same total weight (the product of density of the material times the volume of the club head) and of comparable materials properties such as discussed previously. These principles are directly extended to multiple clubs of the set having heads of different volumes. In other cases, the club-head designer may not wish to achieve constant weights, but instead to have the weights vary in some selected fashion. To continue with the prior example, if the 2-iron having a volume of 39.3 cc is made of the bulk-solidifying amorphous alloy having a density of 5.7 grams, its weight would be 224 grams, a more suitable weight for persons of smaller stature. If the 8-iron of volume 42.7 cc is made of the bulk-solidifying amorphous alloy having a density of 6.2 grams, its weight would be 265 grams, a weight more suitable for persons of larger stature. In all cases, the club heads are made of the amorphous alloys with their superior properties, and which may be cast using the same 2-iron and 8-iron molds by permanent-mold casting. In the example, this range of properties is achieved using only variations of the densities from 5.7 to 6.2 grams per cc. The compositions of alloys within the preferred bulk-solidifying amorphous alloy family permits significantly wider variations of about 5.0 to about 7.0 grams per cc, so that even wider variations in weights are possible.

Although the use of bulk solidifying amorphous alloys on the construction of golf clubs provides substantial advantages, using homogeneous bulk-solidifying amorphous alloys (or bulk metallic glasses) has still some shortcomings. First, these materials generally fail as the result of the formation of localized shear bands with minimal plastic deformation beyond elastic strain limit, which leads to catastrophic failure Secondly, their impact resistance is also limited, which leads to unstable crack growth and propagation upon impacts exceeding design limits. As such their use becomes limited especially considering the durability and unpredictable impact loads during use.

Accordingly, one can improve the golf clubs made of bulk-solidifying amorphous alloys, provided some nominal plastic deformation beyond the elastic strain limit and improved toughness for stable crack growth and propagation is achieved. This is achieved with a new class of material, in-situ composite of bulk-solidifying amorphous alloy (or ductile metal reinforced bulk metallic glass matrix composite) which preserves the desirable properties such as high elastic strain limit up to 2% and high yield strength up to 1.6 Gpa, while providing tensile ductility up to 10% and impact toughness several times of homogenous bulk-solidifying amorphous alloy. Furthermore, the in-situ composite material provides a lower modulus of elasticity, in large part due to lower modulus of dendritic phase (which is an extended solid solution of primary phase of the main constituent element). For example, the Young Modulus of Zr-base alloy (e.g. VIT-1) can be reduced from about 95 GPa down to 80 GPa in the in-situ composite form. As such, this provides a better flexibility of the club face and better design for various hitting speeds.

The following describes the details and preparation of methods of in-situ composites of bulk-solidifying amorphous alloy (or ductile metal reinforced bulk metallic glass matrix composite), As new class of ductile metal reinforced bulk metallic glass matrix composite materials with demonstrated improved mechanical properties. This newly designed engineering material exhibits both improved toughness and a large plastic strain to failure. It should be understood that the golf clubs of the current invention can also be made of these matrix composite materials.

The remarkable glass forming ability of bulk metallic glasses at low cooling rates (e.g., less than about $10^3$ K/sec) allows for the preparation of ductile metal reinforced composites with a bulk metallic glass matrix via in situ processing; i.e., chemical partitioning. The incorporation of a ductile metal phase into a metallic glass matrix yields a constraint that allows for the generation of multiple shear bands in the metallic glass matrix. This stabilizes crack growth in the matrix and extends the amount of strain to failure of the composite. Specifically, by control of chemical composition and processing conditions, a stable two-phase composite (ductile crystalline metal in a bulk metallic glass matrix) is obtained on cooling from the liquid state.

In order to form a composite amorphous metal object by partitioning, one starts with a composition that may not, by itself, form an amorphous metal upon cooling from the liquid phase at reasonable cooling-rates. Instead, the composition includes additional elements or a surplus of some of the components of an alloy that would form a glassy state on cooling from the liquid state.

A particularly attractive bulk glass forming alloy system is described in U.S. Pat. No. 5,288,344, the disclosure of which is hereby incorporated by reference. For example, to form a composite having a crystalline reinforcing phase and an amorphous matrix, one may start with an alloy in the bulk glass forming zirconium-titanium-copper-nickel-beryllium system with added niobium. Such a composition is melted so as to be homogeneous. The molten alloy is then cooled to a temperature range between the liquidus and solidus for the composition. This causes chemical partitioning of the composition into solid crystalline ductile metal dendrites and a liquid phase, with different compositions. The liquid phase becomes depleted of the metals crystallizing into the crystalline phase and the composition shifts to one that forms a bulk metallic glass at low cooling rate. Further cooling of the remaining liquid results in formation of an amorphous matrix around the crystalline phase.

Alloys suitable for practice of this invention have a phase diagram with both a liquidus and a solidus that each include at least one portion that is vertical or sloping, i.e. that is not at a constant temperature.

Figure 8:
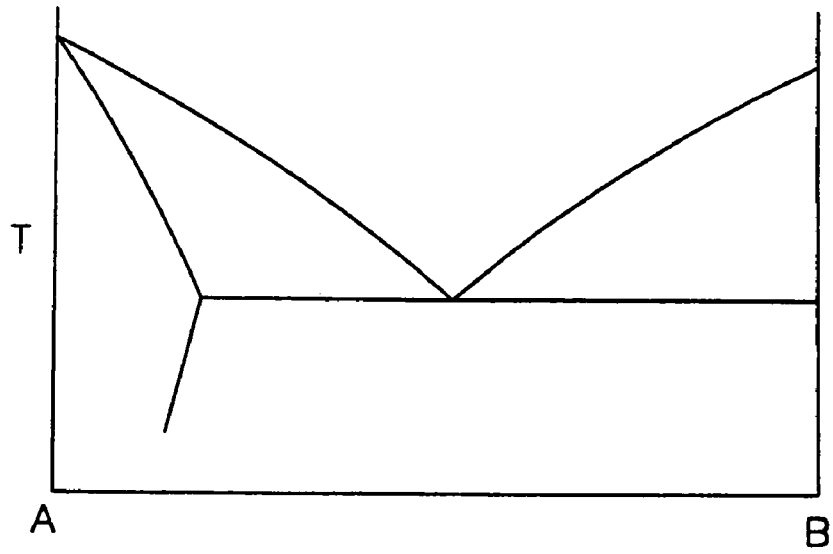
FIG. 8 is a schematic binary phase diagram.

Consider, for example, a binary alloy, AB, having a phase diagram with a eutectic and solid solubility of one metal A in the other metal B as shown in FIG. 8. In such an alloy system the phase diagram has a horizontal or constant temperature solidus line at the eutectic temperature extending from B to a point where B is in equilibrium with a solid solution of B in A. The solidus then slopes upwardly from the equilibrium point to the melting point of A. The liquidus line in the phase diagram extends from the melting point of A to the eutectic composition on the horizontal solidus and from there to the melting point of B. Thus, the solidus has a portion that is not at a constant temperature (between the melting point of A and the equilibrium point). The vertical line from the melting point of B to the eutectic temperature could also be considered a solidus line where there is no solid solubility of A in B. Likewise, the liquidus has sloping lines that are not at constant temperature. In a ternary alloy phase diagram there are solidus and liquidus surfaces instead of lines.

There are no binary or ternary alloys which are presently known to be suitable for practice of this invention. Suitable alloys are quaternary, quinary or even more complex mixtures. Such multidimensional phase diagrams are more difficult to visualize, but also have liquidus and solidus "surfaces". They can be represented in pseudo-binary and pseudo-ternary diagrams where one margin or corner of the diagram is itself an alloy rather than an element.

When referring to the solidus herein, it should be understood that this is not entirely the same as the solidus in a conventional crystalline metal phase diagram, for example. In usage herein, the solidus refers in part to a line (or surface) defining the boundary between liquid metal and a solid phase. This usage is appropriate when referring to the boundary between the melt and a solid crystalline phase precipitated for forming the phase embedded in the matrix. For the glass forming remainder of the melt the "solidus" is typically not at a well defined temperature, but is where the viscosity of the alloy becomes sufficiently high that the alloy is considered to be rigid or solid. Knowing an exact temperature is not important.

Figure 9:
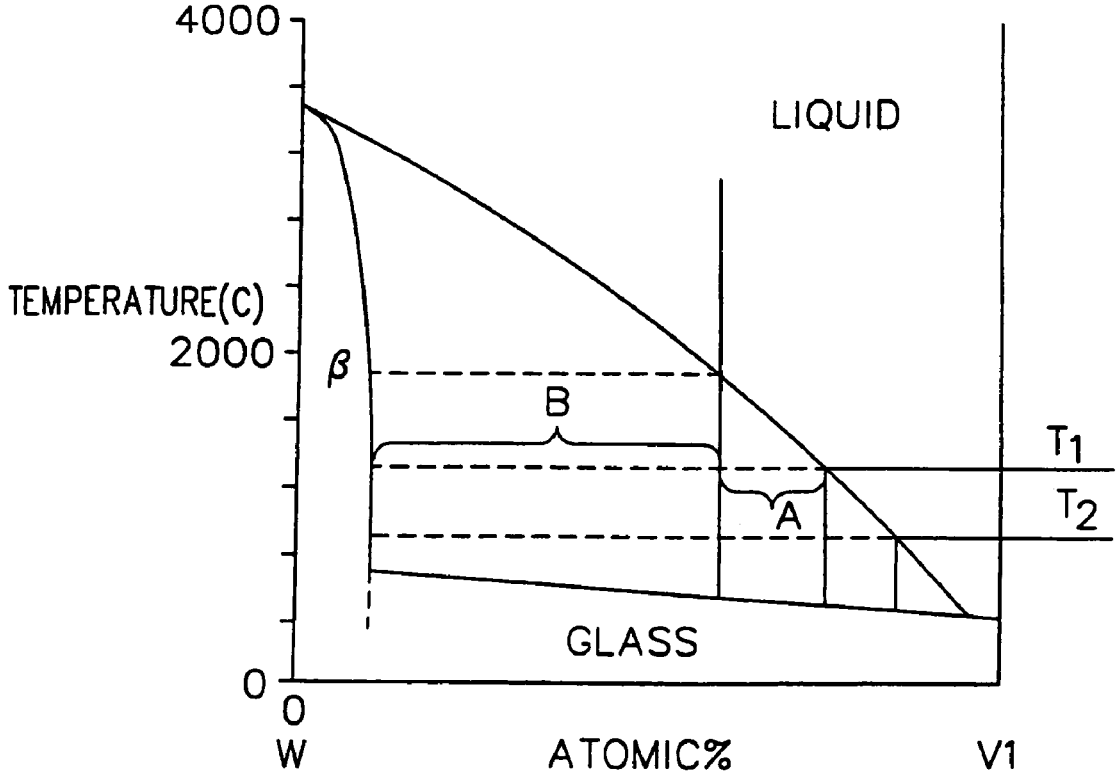
FIG. 9 is a pseudo-binary phase diagram of an exemplary alloy system for forming a composite by chemical partitioning.

Before considering alloy selection, we discuss the partitioning method in a pseudo-binary alloy system. FIG. 9 is a pseudo-binary phase diagram for alloys of M and X where X is a good glass forming composition, i.e. a composition that forms an amorphous metal at reasonable cooling rates. Compositions range from 100% M at the left margin to 100% of the alloy X at the right margin. An upper slightly curved line is a liquidus for M in the alloy and a steeply curving line near the left margin is a solidus for M with some solid solution of components of X in a body centered cubic M alloy. A horizontal or near horizontal line below the liquidus is, in effect, a solidus for an amorphous alloy. A vertical line in mid-diagram is an arbitrary alloy where there is an excess of M above a composition that is a good bulk glass forming alloy.

As one cools the alloy from the liquid, the temperature encounters the liquidus. A precipitation of bcc M (with some of the V1 components, principally titanium and/or zirconium, in solid solution) commences with a composition where a horizontal line from the liquidus encounters the solidus. With further cooling, there is dendritic growth of M crystals, depleting the liquid composition of M, so that the melt composition follows along the sloping liquidus line. Thus, there is a partitioning of the composition to a solid crystalline bcc, M-rich phase and a liquid composition depleted in M.

At an arbitrary processing temperature $T_1$ the proportion of solid M alloy corresponds to the distance A and the proportion of liquid remaining corresponds to the distance B in FIG. 9. In other words, about ¼ of the composition is solid dendrites and the other ¾ is liquid. At equilibrium at a second processing temperature $T_2$ somewhat lower than $T_1$, there is about ⅓ solid crystalline phase and ⅔ liquid phase.

If one cools the exemplary alloy to the first or higher processing temperature $T_1$ and holds at that temperature until equilibrium is reached, and then rapidly quenches the alloy, a composite is achieved having about ¼ particles of bcc alloy distributed in a bulk metallic glass matrix having a composition corresponding to the liquidus at $T_1$. One can vary the proportion of crystalline and amorphous phases by holding the alloy at a selected temperature above the solidus, such as for example, at $T_2$ to obtain a higher proportion of ductile metallic particles.

Instead of cooling and holding at a temperature to reach equilibrium as represented by the phase diagram, one is more likely to cool from the melt continuously to the solid state. The morphology, proportion, size and spacing of ductile metal dendrites in the amorphous metal matrix is influenced by the cooling rate. Generally speaking, a faster cooling rate provides less time for nucleation and growth of crystalline dendrites, so they are smaller and more widely spaced than for slower cooling rates. The orientation of the dendrites is influenced by the local temperature gradient present during solidification. The preferred cooling rate for a desired dendrite morphology and proportion in a specific alloy composition is found with only a few experiments.

For example, to form a composite with good mechanical properties, and having a crystalline reinforcing phase embedded in an amorphous matrix, one may start with compositions based on bulk metallic glass forming compositions in the Zr—Ti—M—Cu—Ni—Be system, where M is niobium. Alloy selection can be exemplified by reference to FIG. 10 which is a section of a pseudo-ternary phase diagram with apexes of titanium, zirconium and X, where X is $Be_9Cu_5Ni_4$. A small circle is indicated near 42% Zr, 13% Ti and 45% X, which is a desirable bulk glass forming alloy composition.

There are at least two strategies for designing a useful composite of crystalline metal particles distributed in an amorphous matrix in this alloy system. Strategy 1 is based on systematic manipulations of the chemical composition of bulk metallic glass forming compositions in the Zr—Ti—Cu—Ni—Be system. Strategy 2 is based on the preparation of chemical compositions which comprise the mixture of additional pure metal or metal alloys with a good bulk metallic glass forming composition in the Zr—Ti—Cu—Ni—Be system.

Strategy 1: Systematic Manipulation of Bulk Metallic Glass Forming Compositions

An excellent bulk metallic glass forming composition has been developed with the following chemical composition: $(Zr_{75}Ti_{25})_{55}X_{45}=Zr_{41.2}Ti_{13.8}Cu_{12.5}Ni_{10}Be_{22.5}$ expressed in atomic percent, and herein labeled as alloy V1. This alloy composition has a proportion of Zr to Ti of 75:25. It is represented on the ternary diagram at the small circle in the large oval.

Around the alloy composition V1 lies a large region of chemical compositions which form a bulk metallic glass object (an object having all of its dimensions greater than one millimeter) on cooling from the liquid state at reasonable rates. This bulk glass forming region (GFR) is defined by the oval labeled as GFR in FIG. 10. When cooled from the liquid state, chemical compositions that lie within this region are fully amorphous when cooled below the glass transition temperature.

The pseudo-ternary diagram shows a number of competing crystalline or quasi-crystalline phases which limit the bulk metallic glass forming ability. Within the GFR these competing crystalline phases are destabilized, and hence do not prevent the vitrification of the liquid on cooling from the molten state. However, for compositions outside the GFR, on cooling from the high temperature liquid state the molten liquid chemically partitions. If the composition is alloyed properly, it forms a good composite engineering material with a ductile crystalline metal phase in an amorphous matrix. There are compositions outside GFR where alloying is inappropriate and the partitioned composite may have a mixture of brittle crystalline phases embedded in an amorphous matrix. The presence of these brittle crystalline phases seriously degrades the mechanical properties of the composite material formed.

For example, toward the upper right of the larger GFR oval, there is a smaller oval partially overlapping the edge of the larger oval, and in this region a brittle $Cu_2ZrTi$ phase may form on cooling the liquid alloy. This is an embrittling phenomenon and such alloys are not suitable for practice of this invention. The regions indicated on this pseudo-ternary diagram are approximate and schematic for illustrating practice of this invention.

Figure 10:
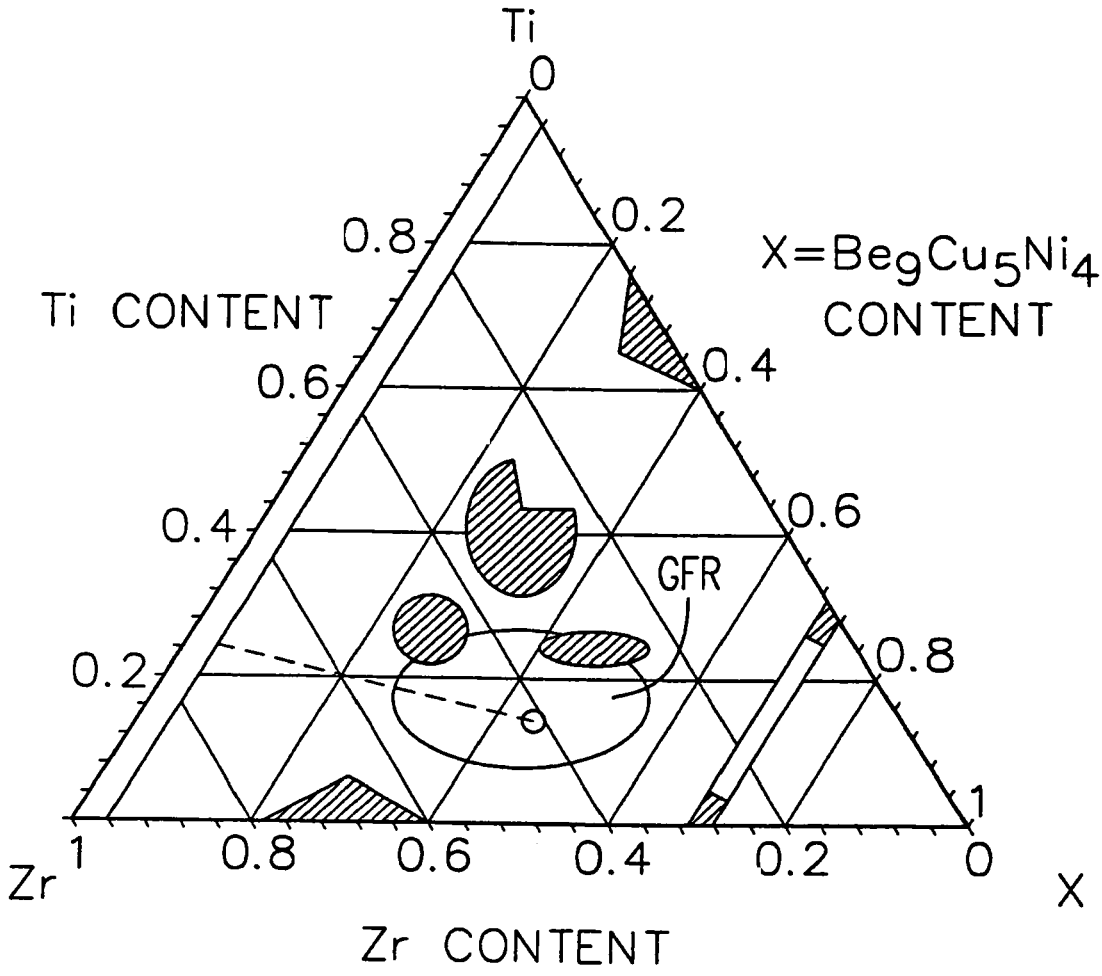
FIG. 10 is a pseudo-ternary phase diagram of a Zr—Ti—Cu—Ni—Be alloy system.

Above the left part of large GFR oval as illustrated in FIG. 10 there is a smaller circle representing a region where a quasi-crystalline phase forms, another embrittling phenomenon. An upper partial oval represents another region where a NiTiZr Laves phase forms. A small triangular region along the Zr-X margin represents formation of intermetallic $TiZrCu_2$ and/or $Ti_2Cu$ phases. Small regions near 70% X are compositions where a $ZrBe_2$ intermetallic or a $TiBe_2$ Laves phase forms. Along the Zr—Ti margin a mixture of and Zr or Zr—Ti alloy may be present.

To form a composite with good mechanical properties, a ductile second phase is formed in situ. Thus, the brittle second phases identified in the pseudo-ternary diagram are to be avoided. This leaves a generally triangular region toward the upper left from the $Zr_{42}Ti_{14}X_{44}$ circle where another metal M may be substituted for some of the zirconium and/or titanium to provide a composite with desirable properties. This is reviewed for a substitution of niobium for some of the titanium.

A dashed line is drawn on FIG. 10 toward the 25% titanium composition on the Zr—Ti margin. In the series of compositions along the dashed line, $(Zr_{100-x}Ti_{x-z}M_z)_{100-y}((Ni_{45}Cu_{55}))_{50}Be_{50})_y$ where M=Nb and x=25, increasing z means decreasing the amount of titanium from the original proportion of 75:25. In the portion of the dashed line within the larger oval, the compositions are good bulk glass forming alloys. Once outside the oval, ductile dendrites rich in zirconium form in a composite with an amorphous matrix. These ductile dendrites are formed by chemical partitioning over a wide range of z and y values.

For example, when z=3 and y=25, there is formation of phase. It has been shown that phase is formed when z=13.3, extending up to z=20 with y values surrounding 25. Excellent mechanical properties have been found for compositions in the range of z=5 to z=10, with a premier composition where z=about 6.66 along this 75:25 line when M is niobium.

It should be noted that one should not extend along the 75:25 dashed line to less than about 5% beryllium, i.e., where y is less than 10. Below that there is little amorphous phase left and the alloy is mostly dendrites without the desirable properties of the composite.

Consider an alloy series of the form $(Zr_{100100-x}Ti_{x-z}M_z)_{100-y}X_y$ where M is an element that stabilizes the crystalline phase in Ti- or Zr-based alloys and X is defined as before. To form an in situ prepared bulk metallic glass matrix composite material with good mechanical properties it is important that the secondary crystalline phase, preferentially nucleated on cooling from the high temperature liquid, be a ductile second phase. An example of an in situ prepared bulk metallic glass matrix composite which has exhibited outstanding mechanical properties has the nominal composition $(Zr_{75}Ti_{18.34}Nb_{6.66})_{75}X_{25}$; i.e., an alloy with M=Nb, z=6.66, x=18.34 and y=25. This is along the dashed line of alloys in FIG. 10.

Peaks on an x-ray diffraction pattern (inset in SEM photomicrograph of FIG. 11) for this composition show that the secondary phase present has a body-centered-cubic (bcc) or phase crystalline symmetry, and that the x-ray pattern peaks are due to the phase only. A Nelson-Riley extrapolation yields a phase lattice parameter a=3.496 Å. Thus, upon cooling from the high temperature melt, the alloy undergoes partial crystallization by nucleation and subsequent dendritic growth of the ductile crystalline metal phase in the remaining liquid. The remaining liquid subsequently freezes to the glassy state producing a two-phase microstructure containing phase dendrites in an amorphous matrix. The final microstructure of a chemically etched specimen is shown in the SEM image of FIG. 11.

SEM electron microprobe analysis gives the average composition for the phase dendrites (light phase in FIG. 11) to be $Zr_{71}Ti_{16.3}Nb_{10}Cu_{1.8}Ni_{0.9}$. Under the assumption that all of the beryllium in the alloy is partitioned into the matrix, we estimate that the average composition of the amorphous matrix (dark phase) is $Zr_{47}Ti_{12.9}Nb_{2.8}Cu_{11}Ni_{9.6}Be_{16.7}$. Microprobe analysis also shows that within experimental error (about ±1 at. %), the compositions within the two phases do not vary. This implies complete solute redistribution and the establishment of chemical equilibrium within and between the phases.

Figure 11:
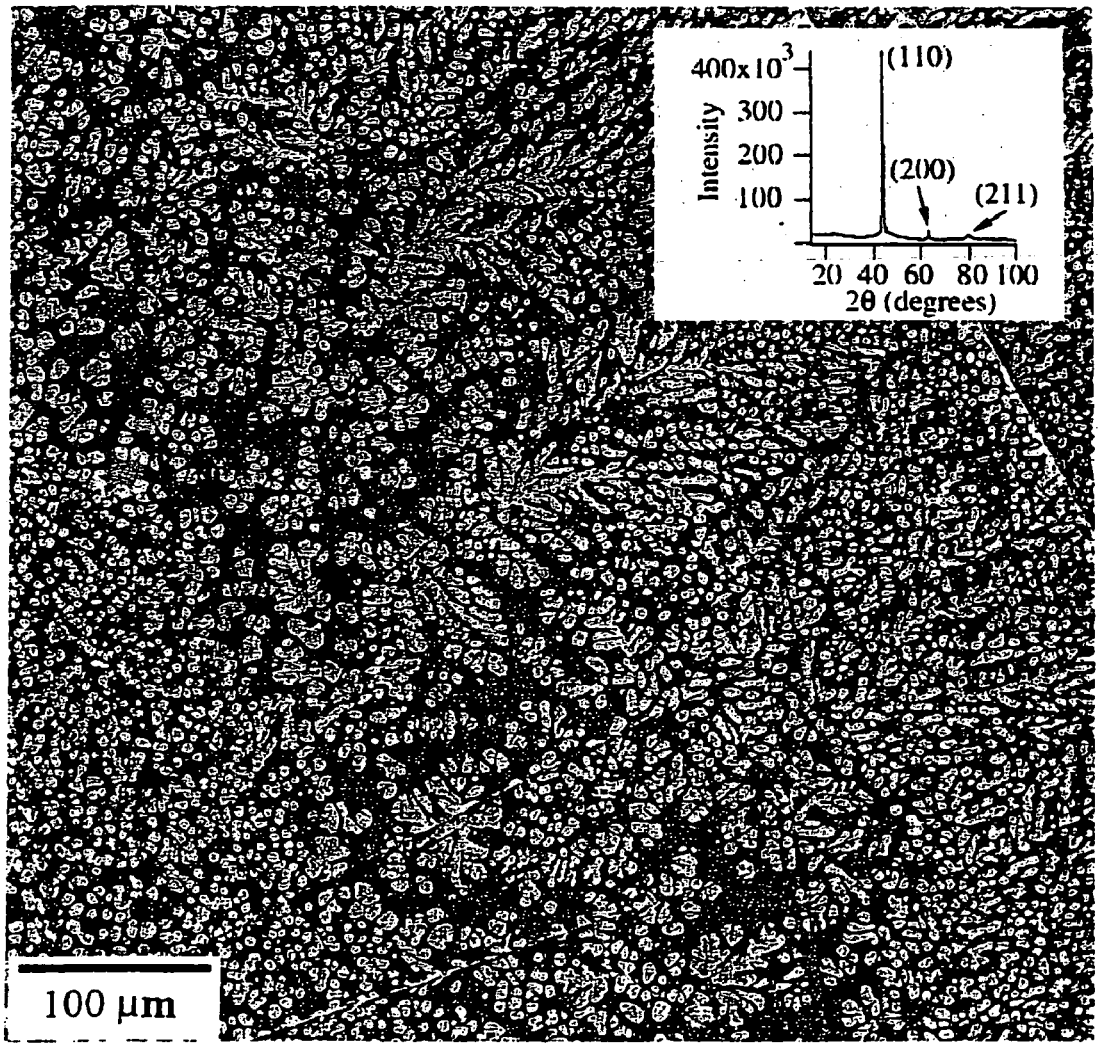
FIG. 11 is an exemplary SEM photomicrograph of an in situ composite formed by chemical partitioning.

Differential scanning calorimetry analysis of the heat of crystallization of the remaining amorphous matrix compared with that of the fully amorphous sample gives a direct estimate of the molar fractions (and volume fractions) of the two phases. This gives an estimated fraction of about 25% phase by volume and about 75% amorphous phase. Direct estimates based on area analysis of the SEM image agree well with this estimate. The SEM image of FIG. 11 shows the fully developed dendritic structure of the phase. The dendritic structures are characterized by primary dendrite axes with lengths of 50-150 micrometers and radius of about 1.5-2 micrometers. Regular patterns of secondary dendrite arms with spacing of about 6-7 micrometers are observed, having radii somewhat smaller than the primary axis. The dendrite "trees" have a very uniform and regular structure. The primary axes show some evidence of texturing over the sample as expected since dendritic growth tends to occur in the direction of the local temperature gradient during solidification.

The relative volume proportion of the phase present in the in situ composite can be varied greatly by control of the chemical composition and the processing conditions. For example, by varying the y value in the alloy series along the dashed line in FIG. 10, $(Zr_{75}Ti_{18.34}Nb_{6.66})_{100-y}X_y$, with M=Nb; i.e., by varying the relative proportion of the early- and late-transition metal constituents; the resultant microstructure and mechanical behavior exhibited on mechanical loading changes dramatically. In situ composites in the Zr—Ti—M—Cu—Ni—Be system have been prepared for alloy series other than the series along the dashed line. These additional alloy series sweep out a region of the quinary composition phase space shown in FIG. 10. The region sweeps in a clockwise direction from a line (not shown) from the V1 alloy composition to the Zr apex of the pseudo-ternary diagram through the dashed line, and extending through to a line (not shown) from the V1 alloy to the Ti apex of the pseudo-ternary diagram, but excluding those regions where a brittle crystalline, quasi-crystalline or Laves phase is stable.

Strategy 2: The Preparation of In Situ Composites by the Mixture of Pure Metal or Metal Alloys With Bulk Metallic Glass Forming Compositions As an additional example of the design of in situ composites by chemical partitioning, we discuss the following series of materials. These alloys are prepared by rule of mixture combinations of a metal or metal alloy with a good bulk metallic glass (BMG) forming composition. The formula for such a mixture is given by BMG(100-x)+M(x) or BMG(100-x)+Nb(x), where M=Nb. Preferably, in situ composite alloys of this form are prepared by first melting the metal or metallic alloy with the early transition metal constituents of the BMG composition. Thus, pure Nb metal is mixed via arc melting with the Zr and Ti of the V1 alloy. This mixture is then arc melted with the remaining constituents; i.e., Cu, Ni, and Be, of the V1 BMG alloy. This molten mixture, upon cooling from the high temperature melt, undergoes partial crystallization by nucleation and subsequent dendritic growth of nearly pure Nb dendrites, with phase symmetry, in the remaining liquid. The remaining liquid subsequently freezes to the glassy state producing a two-phase microstructure containing Nb rich beta phase dendrites in an amorphous matrix.

If one starts with an alloy composition-with an excess of approximately 25 atomic % niobium above a preferred composition ($Zr_{41.2}Ti_{13.8}Cu_{12.4}Ni_{10.1}Be_{22.5}$) for forming a bulk metallic glass, ductile niobium alloy crystals are formed in an amorphous matrix upon cooling a melt through the region between the liquidus and solidus. The composition of the dendrites is about 82% (atomic %) niobium, about 8% titanium, about 8.5% zirconium, and about 1.5% copper plus nickel. This is the composition found when the proportion of dendrites is about ¼ bcc phase and ¾ amorphous matrix. Similar behaviors are observed when tantalum is the additional metal added to what would otherwise be a V1 alloy. Besides niobium and tantalum, suitable additional metals which maybe in the composition for in situ formation of a composite may include molybdenum, chromium, tungsten and vanadium.

The proportion of ductile bcc forming elements in the composition can vary widely. Composites of crystalline bcc alloy particles distributed in a nominally V1 matrix have been prepared with about 75% V1 plus 25% Nb, 67% V1 plus 33% Nb (all percentages being atomic). The dendritic particles of bcc alloy form by chemical partitioning from the melt, leaving a good glass forming alloy for forming a bulk metallic glass matrix.

Partitioning may be used to obtain a small proportion of dendrites in a large proportion of amorphous matrix all the way to a large proportion of dendrites in a small proportion of amorphous matrix. The proportions are readily obtained by varying the amount of metal added to stabilize a crystalline phase. By adding a large proportion of niobium, for example, and reducing the sum of other elements that make a good bulk-metallic glass forming alloy, a large proportion of crystalline particles can be formed in a glassy matrix.

It appears to be important to provide a two phase composite and avoid formation of a third phase. It is clearly important to avoid formation of a third brittle phase, such as an intermetallic compound, Laves phase or quasi-crystalline phase, since such brittle phases significantly degrade the mechanical properties of the composite.

It may be feasible to form a good composite as described herein, with a third phase or brittle phase having a particle size significantly less than 0.1 micrometers. Such small particles may have minimal effect on formation of shear bands and little effect on mechanical properties.

In the niobium enriched Zr—Ti—Cu—Ni—Be system, the microstructure resulting from dendrite formation from a melt comprises a stable crystalline Zr—Ti—Nb alloy, with beta phase (body centered cubic) structure, in a Zr—Ti—Nb—Cu—Ni—Be amorphous metal matrix. These ductile crystalline metal particles distributed in the amorphous metal matrix impose intrinsic geometrical constraints on the matrix that leads to the generation of multiple shear bands under mechanical loading.

Sub-standard size Charpy specimens were prepared from a new in situ formed composite material having a total nominal alloy composition of $Zr_{56.25}Nb_5Ti_{13.76}Cu_{6.875}Ni_{5.625}Be_{12.5}$ These have demonstrated Charpy impact toughness numbers that are 250% greater than that of the bulk metallic glass matrix alone; 15 ft-lb. vs. 6 ft-lb. Bend tests have shown large plastic strain to failure values of about 4%. The multiple shear band structures generated during these bend tests have a periodicity of spacing equal to about 8 micrometers, and this periodicity is determined by the phase dendrite morphology and spacing. In some cast plates with a faster cooling rate, plastic strain to failure in bending has been found to be about 25%. Samples have been found that will sustain a 180□ bend.

Figure 12:
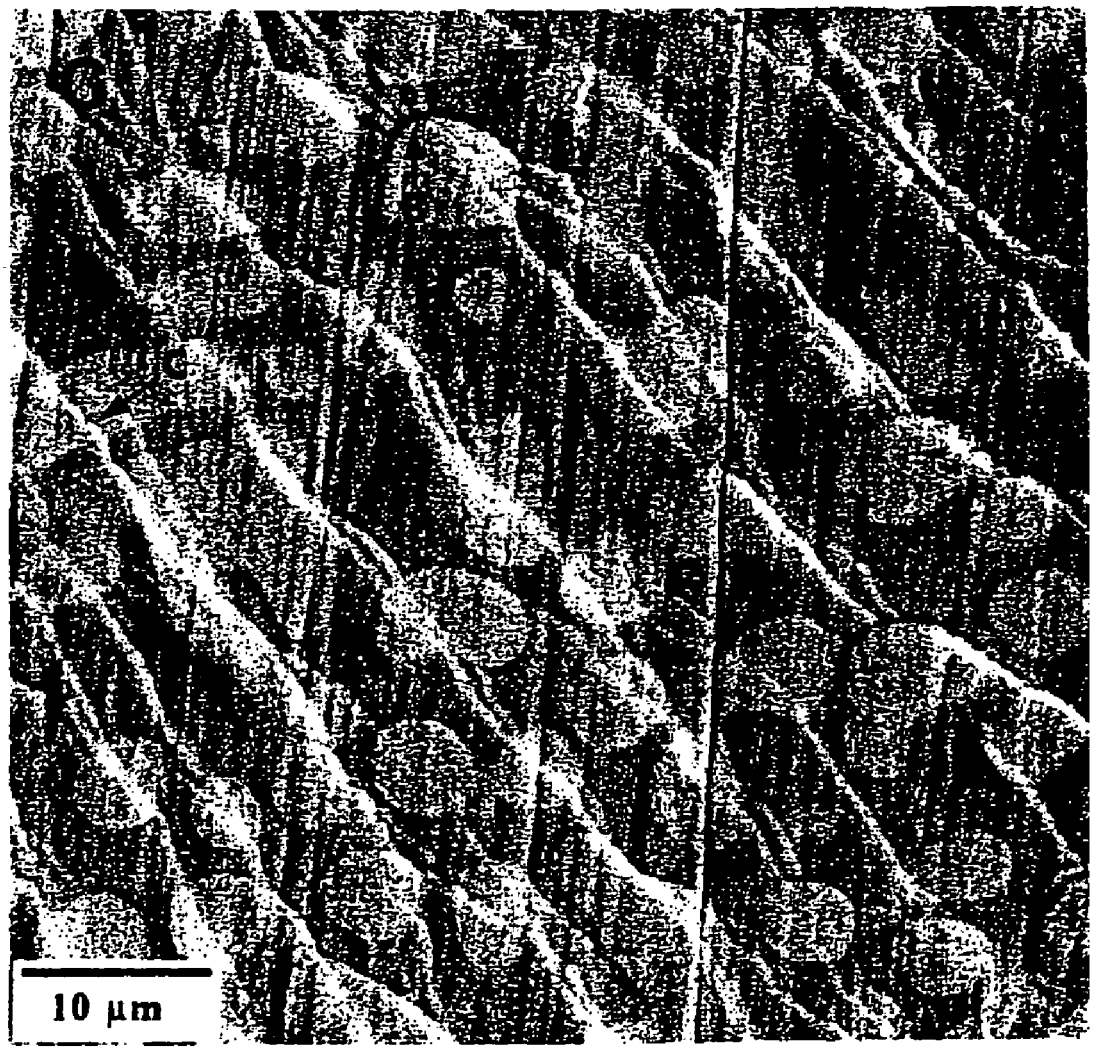
FIG. 12 is an exemplary photomicrograph of such a composite after straining.

In a specimen after straining, as shown in FIG. 12, shear bands can be seen traversing both the amorphous metal matrix phase and the ductile metal dendrite phase. The directions of the shear bands differ slightly in the two phases due to different mechanical properties and probably because of crystal orientation in the dendritic phase.

Shear band patterns as described occur over a wide range of strain rates. A specimen showing shear bands crossing the matrix and dendrites was tested under quasi-static loading with strain rates of about $10^{-4}$ to $10^{-3}$ per second. Dramatically improved Charpy impact toughness values show that this mechanism is operating at strain rates of $10^3$ per second, or higher.

Figure 13:
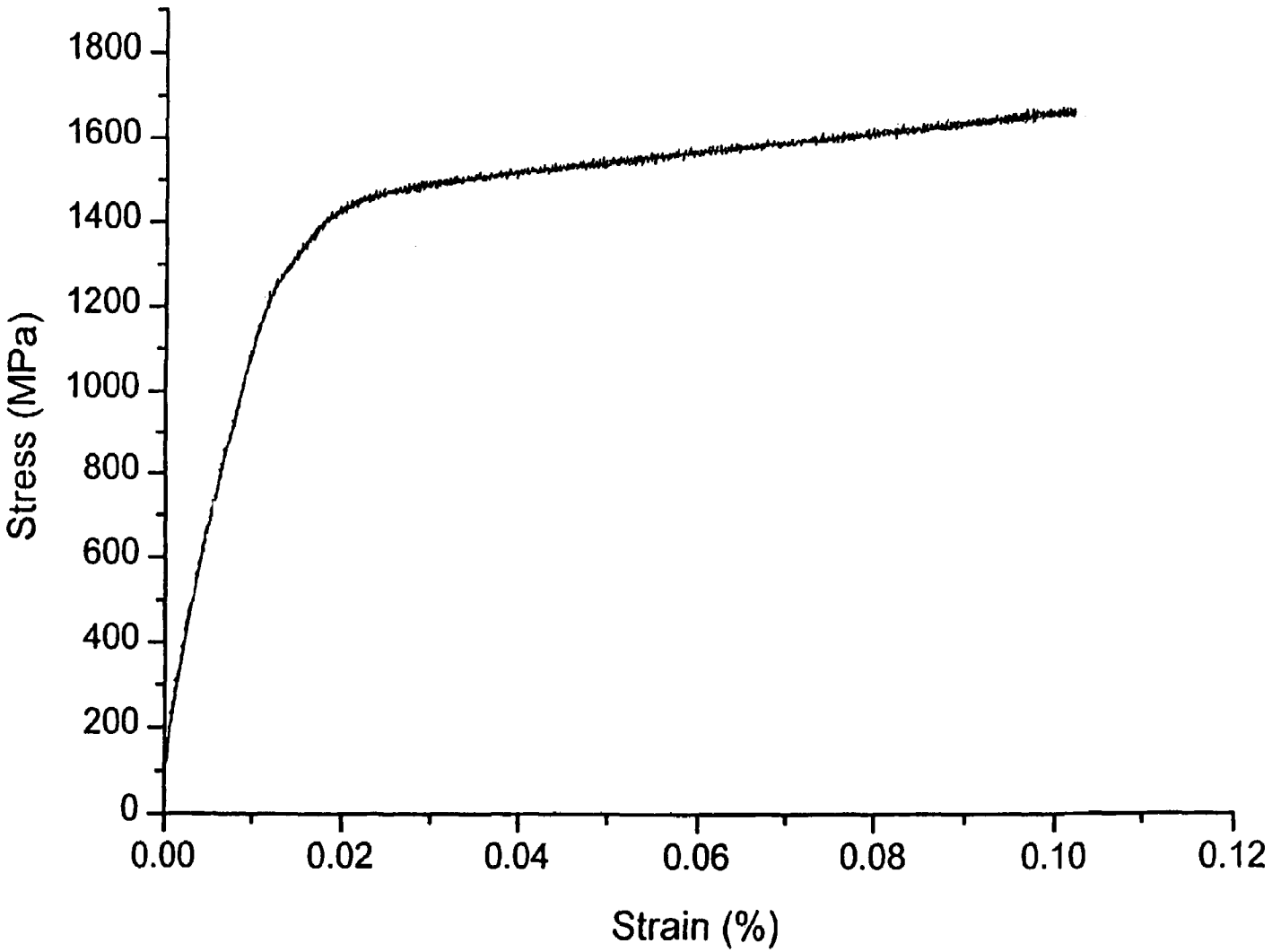
FIG. 13 is a compressive stress-strain curve for such a composite.

Specimens tested under compressive loading exhibit large plastic strains to failure on the order of 8%. An exemplary compressive stress-strain curve as shown in FIG. 13, exhibits an elastic-perfectly-plastic compressive response with plastic deformation initiating at an elastic strain of about 1%. Beyond the elastic limit the stress-strain curve exhibits a slope implying the presence of significant work hardening. This behavior is not observed in bulk metallic glasses, which normally show strain-softening behavior beyond the elastic limit. These tests were conducted with the specimens unconfined, where monolithic amorphous metal would fail catastrophically. In these compression tests, failure occurred on a plane oriented at about 45° from the loading axis. This behavior is similar to the failure mode of the bulk metallic glass matrix. Plates made with faster cooling rates and smaller dendrite sizes have been shown to fail at about 20% strain when tested in tension.

One may also design good bulk glass forming alloys with high titanium content as compared with the high zirconium content alloys described above. Thus, for example, in the Zr—Ti—M—Ni—Cu—Be alloy system a suitable glass forming composition comprises $(Zr_{100-x}Ti_{x-z}M_z)_{100-y}((Ni_{45}Cu_{55}))_{50}Be_{50})_y$, where x is in the range of from 5 to 95, y is in the range of from 10 to 30, z is in the range of from 3 to 20, and M is selected from the group consisting of niobium, tantalum, tungsten, molybdenum, chromium and vanadium. Amounts of other elements or excesses of these elements may be added for partitioning from the melt to form a ductile second phase embedded in an amorphous matrix.

Experimental results indicate that the beta phase morphology and spacing may be controlled by chemical composition and/or processing conditions. This in turn may yield significant improvements in the properties observed; e.g., fracture toughness and high-cycle fatigue. These results offer a substantial improvement over the presently existing bulk metallic glass materials.

Earlier ductile metal reinforced bulk metallic glass matrix composite materials have not shown large improvements in the Charpy numbers or large plastic strains to failure. This is due at least in part to the size and distribution of the secondary particles mechanically introduced into the bulk metallic glass matrix. The substantial improvements observed in the new in situ formed composite materials are manifest by the dendritic morphology, particle size, particle spacing, periodicity and volumetric proportion of the ductile beta phase. This dendrite distribution leads to a confinement geometry that allows for the generation of a large shear band density, which in turn yields a large plastic strain within the material.

Another factor in the improved behavior is the quality of the interface between the ductile metal beta phase and the bulk metallic glass matrix. In the new composites this interface is chemically homogeneous, atomically sharp and free of any third phases. In other words, the materials on each side of the boundary are in chemical equilibrium due to formation of dendrites by chemical partitioning from a melt. This clean interface allows for an iso-strain boundary condition at the particle-matrix interface; this allows for stable deformation and for the propagation of shear bands through the beta phase particles.

Thus, it is desirable to form a composite in which the ductile metal phase included in the glassy matrix has a stress induced martensite transformation. The stress level for transformation induced plasticity, either martensite transformation or twinning, of the ductile metal particles is at or below the shear strength of the amorphous metal phase.

The ductile particles preferably have fcc, bcc or hcp crystal structures, and in any of these crystal structures there are compositions that exhibit stress induced plasticity, although not all fcc, bcc or hcp structures exhibit this phenomenon. Other crystal structures may be too brittle or transform to brittle structures that are not suitable for reinforcing an amorphous metal matrix composite.

This new concept of chemical partitioning is believed to be a global phenomenon in a number of bulk metallic glass forming systems; i.e., in composites that contain a ductile metal phase within a bulk metallic glass matrix, that are formed by in situ processing. For example, similar improvements in mechanical behavior may be observed in $(Zr_{100-x}Ti_{x-z}M_z)_{100-x}(X)_y$ materials, where X is a combination of late transition metal elements that leads to the formation of a bulk metallic glass; in these alloys X does not include Be.

It is important that the crystalline phase be a ductile phase to support shear band deformation through the crystalline phase. If the second phase in the amorphous matrix is an intrinsically brittle ordered intermetallic compound or a Laves phase, for example, there is little ductility produced in the composite material. Ductile deformation of the particles is important for initiating and propagating shear bands. It may be noted that ductile materials in the particles may work harden, and such work hardening can be mitigated by annealing, although it is important not to exceed a glass transition temperature that would lose the amorphous phase.

The particle size of the dendrites of crystalline phase can also be controlled during the partitioning. If one cools slowly through the region between the liquidus and processing temperature, few nucleation sites occur in the melt and relatively larger particle sizes can be formed. On the other hand, if one cools rapidly from a completely molten state above the liquidus to a processing temperature and then holds at the processing temperature to reach near equilibrium, a larger number of nucleation sites may occur, resulting in smaller particle size.

The particle size and spacing between particles in the solid phase may be controlled by cooling rate between the liquidus and solidus, and/or time of holding at a processing temperature in this region. This may be a short interval to inhibit excessive crystalline growth. The addition of elements that are partitioned into the crystalline phase may also assist in controlling particle size of the crystalline phase. For example, addition of more niobium apparently creates additional nucleation sites and produces finer grain size. This can leave the volume fraction of the amorphous phase substantially unchanged and simply change the particle size and spacing. On the other hand, a change in temperature between the liquidus and solidus from which the alloy is quenched can control the volume fraction of crystalline and amorphous phases. A volume fraction of ductile crystalline phase of about 25% appears near optimum.

In one example, the solid phase formed from the melt may have a composition in the range of from 67 to 74 atomic percent zirconium, 15 to 17 atomic percent titanium, 1 to 3 atomic percent copper, 0 to 2 atomic percent nickel, and 8 to 12 atomic percent niobium. Such a composition is crystalline, and would not form an amorphous alloy at reasonable cooling rates.

The remaining liquid phase has a composition in the range of from 35 to 43 atomic percent zirconium, 9 to 12 atomic percent titanium, 7 to 11 atomic percent copper, 6 to 9 atomic percent nickel, 28 to 38 atomic percent beryllium, and 2 to 4 atomic percent niobium. Such a composition falls within a range that forms amorphous alloys upon sufficiently rapid cooling.

Upon cooling through the region between the liquidus and solidus at a rate estimated at less than 50 K/sec, ductile dendrites are formed with primary lengths of about 50 to 150 micrometers. (Cooling was from one face of a one centimeter thick body in a water cooled copper crucible.) The dendrites have well developed secondary arms in the order of four to six micrometers wide, with the secondary arm spacing being about six to eight micrometers. It has been observed in compression tests of such material that shear bands are equally spaced at about seven micrometers. Thus, the shear band spacing is coherent with the secondary arm spacing of the dendrites.

In other castings with cooling rates significantly greater, probably at least 100 K/sec, the dendrites are appreciably smaller, about five micrometers along the principal direction and with secondary arms spaced about one to two micrometers apart. The dendrites have more of a snowflake-like appearance than the more usual tree-like appearance. Dendrites seem less uniformly distributed and occupy less of the total volume of the composite (about 20%) than in the more slowly cooled composite. (Cooling was from both faces of a body 3.3 mm thick.) In such a composite, the shear bands are more dense than in the composite with larger and more widely spaced dendrites. It is estimated that in the first composite about four to five percent of the volume is in shear bands, whereas in the "finer grained" composite the shear bands are from two to five times as dense. This means that there is a greater amount of deformed metal, and this is also shown by the higher strain to failure in the second composite.

As used herein, when speaking of particle size or particle spacing, the intent is to refer to the width and spacing of the secondary arms of the dendrites, when present. In absence of a dendritic structure, particle size would have its usual meaning, i.e. for round or nearly round particles, an average diameter. It is also possible that acicular or lamellar ductile metal structures may be formed in an amorphous matrix. Width of such structures is considered as particle size. It will also be noted that the secondary arms in a dendritic are not uniform width; they taper from a wider end adjacent the principal axis toward a pointed or slightly rounded free end. Thus, the "width" is some value between the ends in a region where shear bands propagate. Similarly, since the arms are wider at the base, the spacing between arms narrows at that end and widens toward the tips. Shear bands seem to propagate preferentially through regions where the width and spacing are about the same magnitude. The dendrites are, of course, three dimensional structures and the shear bands are more or less planar, so this is only an approximation.

When referring to particle spacing, the center-to-center spacing is intended, even if the text may inadvertently refer to the spacing in a context that suggests edge-to-edge spacing.

One may also control particle size by providing artificial nucleation sites distributed in the melt. These may be minute ceramic particles of appropriate crystal structure or other materials insoluble in the melt. Agitation may also be employed to affect nucleation and dendrite growth. Cooling rate techniques are preferred since repeatable and readily controlled.

It appears that the improved mechanical properties can be obtained from such a composite material where the second ductile metal phase embedded in the amorphous metal matrix, has a particle size in the range of from about 0.1 to 15 micrometers. If the particles are smaller than 100 nanometers, shear bands may effectively avoid the particles and there is little if any effect on the mechanical properties. If the particles are too large, the ductile phase effectively predominates and the desirable properties of the amorphous matrix are diluted. Preferably, the particle size is in the range of from 0.5 to 8 micrometers since the best mechanical properties are obtained in that size range. The particles of crystalline phase should not be too small or they are smaller than the width of the shear bands and become relatively ineffective. Preferably, the particles are slightly larger than the shear band spacing.

The spacing between adjacent particles should be in the range of from 0.1 to 20 micrometers. Such spacing of a ductile metal reinforcement in the continuous amorphous matrix induces a uniform distribution of shear bands throughout a deformed volume of the composite, with strain rates in the range of from about $10^{-4}$ to $10^{3}$ per second. Preferably, the spacing between particles is in the range of from 1 to 10 micrometers for the best mechanical properties in the composite.

The volumetric proportion of the ductile metal particles in the amorphous matrix is also significant. The ductile particles are preferably in the range of from 5 to 50 volume percent of the composite, and most preferably in the range of from 15 to 35% for the best improvements in mechanical properties. When the proportion of ductile crystalline metal phase is low, the effects on properties are minimal and little improvement over the properties of the amorphous metal phase may be found. On the other hand, when the proportion of the second phase is large, its properties dominate and the valuable assets of the amorphous phase are unduly diminished.

There are circumstances, however, when the volumetric proportion of amorphous metal phase may be less than 50% and the matrix may become a discontinuous phase. Stress induced transformation of a large proportion of in situ formed crystalline metal modulated by presence of a smaller proportion of amorphous metal may provide desirable mechanical properties in a composite.

The size of and spacing between the particles of ductile crystalline metal phase preferably produces a uniform distribution of shear bands having a width of the shear bands in the range of from about 100 to 500 nanometers. Typically, the shear bands involve at least about four volume percent of the composite material before the composite fails in strain. Small spacing is desirable between shear bands since ductility correlates to the volume of material within the shear bands. Thus, it is preferred that there be a spacing between shear bands when the material is strained to failure in the range of from about 1 to 10 micrometers. If the spacing between bands is less than about ½ micrometer or greater than about 20 micrometers, there is little toughening effect due to the particles. The spacing between bands is preferably about two to five times the width of the bands. Spacings of as much as 20 times the width of the shear bands can produce engineering materials with adequate ductility and toughness for many applications.

In one example, when the band density is about 4% of the volume of the material, the energy of deformation before failure is estimated to be in the order of 23 joules (with a strain rate of about $10^{2}$ to $10^{3}$/sec in a Charpy-type test. Based on such estimates, if the shear band density were increased to 30 volume percent of the material, the energy of deformation rises to about 120 joules.

For alloys usable for making objects with dimensions larger than micrometers, cooling rates from the region between the liquidus and solidus of less than 1000 K/sec are desirable. Preferably, cooling rates to avoid crystallization of the glass forming alloy are in the range of from 1 to 100 K/sec or lower. For identifying acceptable glass forming alloys, the ability to form layers at least 1 millimeter thick has been selected. In other words, an object having an amorphous metal matrix has a thickness of at least one millimeter in its smallest dimension.

From these illustrative examples, it is apparent that the golf-club designer has available an important new approach by which golf clubs may be designed both as to their physical configuration and size (and thence volume) and an independently selected material density. The selection of these characteristics permits the golf clubs to be tailored to individual performance and characteristics of golfers.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A golf club, comprising:

a club shaft; and a club head, wherein at least one of the club shaft and the club head being made at least in part of a composite material comprising an amorphous metal alloy forming a substantially continuous matrix; and a second ductile metal phase embedded in the matrix and formed in situ in the matrix by crystallization from a molten alloy, and wherein the second phase is sufficiently spaced apart for inducing a uniform distribution of shear bands throughout a deformed volume of the composite, the shear bands involving at least four volume percent of the composite before failure in strain and traversing both the amorphous metal phase and the second phase, and wherein the composite material has the following specific properties:

an elastic strain limit of around 2.0%, a yield strength of around 1.6 GPa, and a tensile ductility of from 5 to 10%.

2. The golf club of claim 1, wherein at least a part of the club head is made of the composite material.

3. The golf club of claim 1, wherein the club head is a driver club head.

4. The golf club of claim 1, wherein the club head has a club head face made of the composite material.

5. The golf club of claim 1, wherein the club head face has a thickness of less than about 2.5 millimeters.

6. The golf club of claim 1, wherein the second ductile phase is formed from a molten alloy having an original composition in the range of from 52 to 68 atomic percent zirconium, 3 to 17 atomic percent titanium, 2.5 to 8.5 atomic percent copper, 2 to 7 atomic percent nickel, 5 to 15 atomic percent beryllium, and 3 to 20 atomic percent niobium.

7. The golf club of claim 1, wherein the second phase comprises particles having a particle size in the range of from 0.1 to 15 micrometers.

8. The golf club of claim 1, wherein the second phase comprises particles having a spacing between adjacent particles in the range of from 0.1 to 20 micrometers.

9. The golf club of claim 1, wherein the second phase comprises in the range of from 15 to 35 volume percent of the composite.

10. A golf club, comprising:

a club shaft; and a club head, wherein at least one of the club shaft and the club head being made at least in part of a composite material comprising:

a bulk-solidifying amorphous alloy forming a substantially continuous matrix;

a second phase embedded in the matrix, the second phase comprising ductile metal particles having a particle size in the range of from 0.1 to 15 micrometers and a spacing between adjacent particles in the range of from 0.1 to 20 micrometers; and wherein the composite material has the following specific properties: an elastic strain limit of around 2.0%, a yield strength of around 1.6 GPa, and a tensile ductility of from 5 to 10%.

11. The golf club as recited in claim 10 wherein the second phase is formed by in situ precipitation from a molten alloy.

12. The golf club as recited in claim 10 wherein the ductile metal particles have a particle size in the range of from 0.5 to 8 micrometers and a spacing between adjacent particles in the range of from 1 to 10 micrometers.

13. The golf club as recited in claim 10 wherein the second phase is formed in situ from a molten alloy having an original composition in the range of from 52 to 68 atomic percent zirconium, 3 to 17 atomic percent titanium, 2.5 to 8.5 atomic percent copper, 2 to 7 atomic percent nickel, 5 to 15 atomic percent beryllium, and 3 to 20 atomic percent niobium.

14. A golf club comprising:

a club shaft; and a club head, wherein at least one of the club shaft and the club head being made at least in part of a composite material comprising:

an amorphous metal alloy forming a substantially continuous matrix; and a second phase embedded in the matrix, the second phase comprising ductile crystalline metal particles sufficiently spaced apart for inducing a uniform distribution of shear bands throughout a deformed volume of the composite, the shear bands involving at least about four volume percent of the composite before failure in strain and traversing both the amorphous metal phase and the second phase, and wherein the composite material has the following specific properties:

an elastic strain limit of around 2.0%, a yield strength of around 1.6 GPa, and a tensile ductility of from 5 to 10%.

15. The golf club as recited in claim 14 wherein second phase is in the form of dendrites.

16. The golf club as recited in claim 14 wherein the second phase has a modulus of elasticity less than the modulus of elasticity of the amorphous metal alloy.

17. The golf club as recited in claim 14 wherein the second phase comprising ductile metal particles are sufficiently spaced apart for inducing a uniform distribution of shear bands traversing both the amorphous phase and the second phase and having a width of each shear band in the range of from 100 to 500 nanometers.

18. The golf club as recited in claim 14 wherein the second phase comprising a ductile metal alloy has an interface in chemical equilibrium with the amorphous metal matrix.

19. The golf club as recited in claim 14 wherein the stress level for transformation induced plasticity of the ductile metal particles is at or below the shear strength of the amorphous metal matrix.

20. A golf club comprising:

a club shaft; and a club head, wherein at least one of the club shaft and the club head being made at least in part of a composite material comprising:

an amorphous metal alloy forming a substantially continuous matrix, the alloy comprising $(Zr_{100-x}Ti_{x-z}M_z)_{100-y}((Ni_{45}Cu_{55}))_{50}Be_{50})_y$ where x is in the range of from 5 to 95, y is in the range of from 10 to 30, z is in the range of from 3 to 20, and M is selected from the group consisting of niobium, tantalum, tungsten, molybdenum, chromium and vanadium; and a second phase embedded in the matrix, the second phase comprising a ductile crystalline metal alloy containing M; and wherein the composite material has the following specific properties an elastic strain limit of around 2.0%, a yield strength of around 1.6 GPa, and a tensile ductility of from 5 to 10%.

21. A golf club comprising:

a club shaft; and a club head, wherein at least one of the club shaft and the club head being made at least in part of a composite material comprising:

an amorphous metal alloy forming a substantially continuous matrix; and a second phase embedded in the matrix, the second phase comprising a ductile crystalline metal alloy; and wherein the second phase is formed in situ from a molten alloy having an original composition in the range of from 52 to 75 atomic percent zirconium, 3 to 17 atomic percent titanium, 2.5 to 8.5 atomic percent copper, 2 to 7 atomic percent nickel, 5 to 15 atomic percent beryllium, and 3 to 20 atomic percent niobium; and wherein the second phase is sufficiently spaced apart for inducing a uniform distribution of shear bands throughout a deformed volume of the composite, the shear bands involving at least four volume percent of the composite before failure in strain and traversing both the amorphous metal phase and the second phase; and wherein the composite material has the following specific properties an elastic strain limit of around 2.0%, a yield strength of around 1.6 GPa, and a tensile ductility of from 5 to 10%.

* * * * *